US011169457B2

(12) United States Patent
Ikeda et al.

(10) Patent No.: US 11,169,457 B2
(45) Date of Patent: Nov. 9, 2021

(54) ELECTROPHOTOGRAPHIC IMAGE FORMING METHOD AND ELECTROPHOTOGRAPHIC IMAGE FORMING SYSTEM

(71) Applicant: Konica Minolta, Inc., Tokyo (JP)

(72) Inventors: Kengo Ikeda, Kitamoto (JP); Hiroki Takao, Hachioji (JP); Tomoko Sakimura, Hino (JP); Mayuko Matsusaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/828,037

(22) Filed: Mar. 24, 2020

(65) Prior Publication Data

US 2020/0319566 A1 Oct. 8, 2020

(30) Foreign Application Priority Data

Apr. 3, 2019 (JP) ..... JP2019-071087

(51) Int. Cl.

| | |
|---|---|
| ***G03G 5/147*** | (2006.01) |
| ***G03G 15/00*** | (2006.01) |
| ***G03G 9/08*** | (2006.01) |
| ***G03G 9/097*** | (2006.01) |

(52) U.S. Cl.

CPC ..... *G03G 5/14773* (2013.01); *G03G 5/14704* (2013.01); *G03G 9/0819* (2013.01); *G03G 9/09708* (2013.01); *G03G 15/75* (2013.01)

(58) Field of Classification Search

CPC ..... G03G 5/14; G03G 5/147; G03G 5/14704; G03G 5/1408

See application file for complete search history.

(56) References Cited

U.S. PATENT DOCUMENTS

2015/0086917 A1* 3/2015 Iwasaki ..... G03G 9/09716 430/106.1

FOREIGN PATENT DOCUMENTS

| | | | | |
|---|---|---|---|---|
| JP | 2001-066814 | * | 3/2001 | ..... G03G 5/147 |
| JP | 0 2005-249876 | * | 9/2005 | ..... G03G 5/147 |
| JP | 2011-013668 A | | 1/2011 | |
| JP | 2012-123238 | * | 6/2012 | ..... G03G 5/147 |
| JP | 2014-228763 A | | 12/2014 | |

OTHER PUBLICATIONS

Translation of abstract of JP 2005-29876.*
Translation of JP 2001-066814.*
Translation of JP 2012-123238.*

* cited by examiner

*Primary Examiner* — Peter L Vajda
(74) *Attorney, Agent, or Firm* — Lucas & Mercanti, LLP

(57) ABSTRACT

The present invention provides an electrophotographic image forming method using an electrophotographic photoconductor. The electrophotographic photoconductor has a protective layer. The surface of the protective layer has a projection structure. The average distance between neighboring projections among a plurality of projections R is set within the range of 100 to 250 nm. A toner including titanate compound particles attached to toner base particles is used.

12 Claims, 5 Drawing Sheets

ELECTROPHOTOGRAPHIC IMAGE FORMING METHOD AND ELECTROPHOTOGRAPHIC IMAGE FORMING SYSTEM

BACKGROUND

Technological Field

The present invention relates to an electrophotographic image forming method and an electrophotographic image forming system, particularly relates to an electrophotographic image forming method and the like capable of suppressing the amount of a liberated external additive generated, of reducing wear of a photoconductor and wear of a cleaning blade, and of suppressing image defects due to cleaning failure.

Description of the Related Art

Conventionally, in toners for electrostatic image development, an external additive has been added to the surface of toner base particles, from the viewpoint of improving chargeability and flowability. As such an external additive, titanium dioxide ($TiO_2$) as a charge control agent has been widely used. However, titanium dioxide, which has low resistance, migrates to carrier particles during high coverage printing, facilitating transfer of charge of the carrier particles. This causes a problem of a decrease in the amount of charge of the toner.

Thus, in order to allow titanium oxide particles (titanate compound particles) to have resistance comparable to that of the carrier, a method of increasing the amount of the surface of the titanium oxide particles treated can be mentioned. However, in order to adjust the resistance value of the titanium oxide particles such that the particles have a value comparable to that of the carrier, the amount of the surface treated becomes excessive. When the amount of the surface treated becomes excessive, the aggregation property of the external additive increases, and the flowability of the toner decreases. As a result, the amount of charge is lowered.

Then, attempts have been made to improve the charging performance of a toner by use of a titanate compound having high dielectricity. As is known, for example, it is possible to provide a toner in which a titanate compound is used as an external additive, the toner exerting charging performance and cleaning performance in a well-balanced manner, and causing no image defects due to aggregation of the titanate compound (see JP 2011-13668A). It is also known that a toner containing metal oxide particles such as titanate compound particles and fatty acid metal salt particles as external additives has satisfactory cleaning ability and can suppress uneven wear of photoconductors and cleaning blades (see JP 2014-228763A).

However, when a titanate compound is used, aggregates of the titanate compound externally added are unlikely to be crushed. Thus, adhesion force to toner base particles of an additional external additive (such as large-diameter silica) decreases due to an excessive spacer effect. As a result, there occurs a problem of an increase in the amount of a liberated external additive. In the meantime, if high coverage images are sequentially printed, the liberated external additive and other aggregates thereof cause a difference in the amount of wear of the photoconductor between an image band portion and a non-band portion, and also cause wear and scratches of the blade, leading to image defects due to escape of the external additives. Particularly, when the titanate compound has a large diameter, cleaning failure becomes marked. The condition of the contact between the toner and the photoconductor markedly contributes to the cleaning ability. Thus, excellent cleaning ability is desirably achieved in combination not only with the toner design but also with the photoconductor design.

SUMMARY

The present invention has been made in the view of the above problems and situations, and a problem to be solved thereof is to provide an electrophotographic image forming method and an electrophotographic image forming system capable of suppressing the amount of a liberated external additive generated, reducing wear of a photoconductor and wear of a cleaning blade, and of suppressing image defects due to cleaning failure.

In an attempt to solve the above problems, the present inventor has found that, in a process of investigating causes and the like of the above problems, the amount of a liberated external additive generated can be suppressed, wear of a photoconductor and wear of a cleaning blade can be reduced, and image defects due to cleaning failure can be suppressed by identifying the average distance between projections on the protective layer surface of an electrophotographic photoconductor and using a toner including titanate compound particles as an external additive attached thereto, having arrived at the present invention.

In order to achieve at least one of the abovementioned objects, according to one aspect of the present invention, the electrophotographic image forming method is an electrophotographic image forming method using an electrophotographic photoconductor, wherein the electrophotographic photoconductor has a protective layer, the surface of the protective layer has a projection structure, the average distance between neighboring projections among a plurality of projections R is set within the range of 100 to 250 nm, and a toner including titanate compound particles attached to toner base particles is used.

According to another aspect of the present invention, the electrophotographic image forming system is an electrophotographic image forming system including an electrophotographic image forming apparatus having an electrophotographic photoconductor and a toner, wherein the electrophotographic photoconductor has a protective layer, the surface of the protective layer has a projection structure, the average distance between neighboring projections among a plurality of projections R is within the range of 100 to 250 nm, and the toner contains toner base particles including titanate compound particles attached thereto.

According to the above means of the present invention, it is possible to provide an electrophotographic image forming method and an electrophotographic image forming system capable of suppressing the amount of a liberated external additive generated, reducing wear of a photoconductor and wear of a cleaning blade, and of suppressing image defects due to cleaning failure.

The mechanism by which the effects of the present invention is exhibited or exerted has not been revealed, but is assumed to be as follows.

Setting the average distance between projections of the photoconductor to 250 nm or less makes the projections uniform and dense and thus can enhance the probability of contact between the inorganic filler of the photoconductor and the external additive of the toner. This can reduce the friction force and adhesion force between the photoconductor and the toner. Then, the toner is reliably and rapidly discharged, and a state in which the amount of the liberated external additive is small is achieved Making the toner easy to clean can reduce the load on the cleaning blade and can suppress wear both of the photoconductor/cleaning blade for a long period. Additionally, when the amount of the liberated external additive decreases, escape of the external additive is suppressed, and image defects due to cleaning failure can be suppressed.

In other words, the inorganic filler rises on the protective layer of the photoconductor to thereby allow the surface of the photoconductor to have projections formed of the inorganic filler. The average distance between projections varies in accordance with the amount of the inorganic filler added and the dispersibility of the inorganic filler. Uniformly dispersing inorganic filler particles at a high concentration in the protective layer without aggregation can make the average distance between projections shorter.

Setting the average distance between projections formed of the inorganic filler on the surface of the photoconductor of the present invention to 250 nm or less makes the projections uniform and dense and thus can enhance the probability of contact between the inorganic filler and the external additive of the toner. For example, as shown in FIG. 1, when an external additive 202 of a toner 201 comes in contact with an inorganic filler 204 of a photoconductor protective layer 203, that is, metal oxide particles come in contact with each other, the friction force and adhesion force between the toner 201 and the protective layer 203 can be reduced. Additionally, the friction force and adhesion force can be further reduced by surface-modifying the inorganic filler 204 of the protective layer 203. In FIG. 1, a reference numeral 205 indicates a surface-modified inorganic filler.

In order to shorten the average distance between projections formed of the inorganic filler, raising the filler concentration is effective. However, with an excessive high filler concentration, the amount of the polymerization-cured resin relatively decreases, and thus, the crosslinking strength decreases. This makes the protective layer brittle, and photoconductor wear increases. From the reason described above, the average distance between projections formed of the inorganic filler is required to be 100 nm or more.

Since the friction force and adhesion force can be reduced, the plunging force of the remaining toner 201 to the cleaning blade 206 decreases (see FIG. 2). Then, the decrease in this plunging force suppresses liberation of the external additive and thus can prevent excessive generation of the liberated external additive and aggregates thereof. As a result, the toner is reliably and rapidly discharged, the load during cleaning decreases, the amount of wear of the photoconductor and the cleaning blade is lowered, and sufficient cleaning ability can be provided.

BRIEF DESCRIPTION OF THE DRAWINGS

The advantages and features provided by one or more embodiments of the invention will become more fully understood from the detailed description given hereinbelow and the appended drawings which are given by way of illustration only, and thus are no intended as a definition of the limits of the present invention, wherein.

DETAILED DESCRIPTION OF EMBODIMENTS

Figure 1:
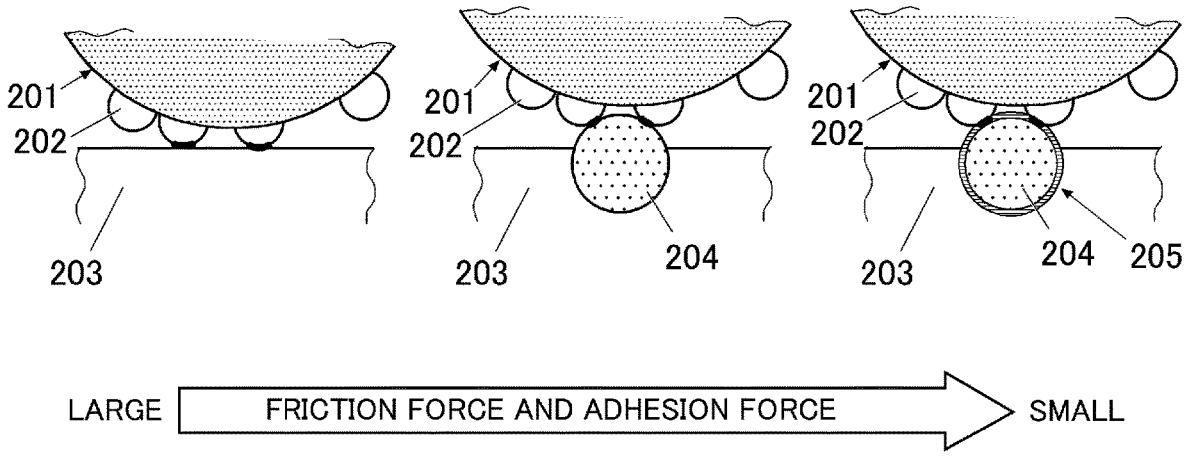
FIG. 1 is a schematic view illustrating a relation between the state of contact of a photoconductor with a toner and friction force and adhesion force.
Figure 2:
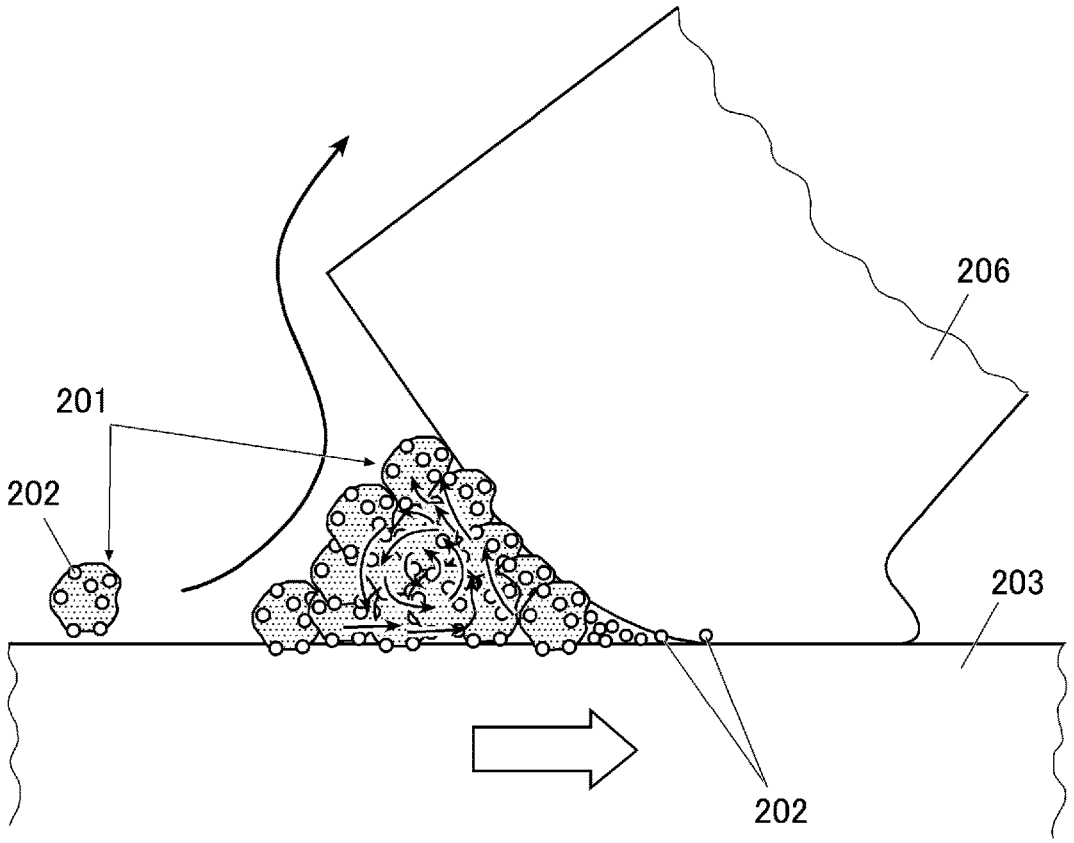
FIG. 2 is a schematic view illustrating plunging force of the toner to a cleaning blade.

Hereinbelow, embodiments of an electrophotographic image forming method and an electrophotographic image forming system of the present invention will be described in reference to the drawings. However, the scope of the invention is not limited to the disclosed embodiments.

The electrophotographic image forming method of the present invention is an electrophotographic image forming method using an electrophotographic photoconductor, wherein the electrophotographic photoconductor has a protective layer, the surface of the protective layer has a projection structure, the average distance between neighboring projections among a plurality of projections R is set within the range of 100 to 250 nm, and a toner including titanate compound particles attached to toner base particles is used.

These characteristics are technical characteristics common to or corresponding to each of the following embodiments.

As an embodiment of the present invention, it is preferable that the protective layer contain a polymerization-cured product of a composition containing a polymerizable monomer and an inorganic filler with respect that wear of a photoconductor can be reduced.

It is preferable that the protective layer contain an inorganic filler surface-modified with a surface modifier with respect that wear of a cleaning blade can be reduced.

It is preferable that the surface modifier have a silicone chain, and particularly, the surface modifier have a silicone chain as a side chain with respect that wear of a cleaning blade can be further reduced.

It is preferable that the number average primary particle size of the inorganic filler be within the range of 50 to 200 nm with respect that cleaning ability is more improved and wear of the photoconductor and wear of the cleaning blade can be further reduced.

It is preferable that the titanate compound particles be calcium titanate particles or strontium titanate particles with respect that the amount of charge is maintained at a constant level for a long period.

It is preferable that the number average primary particle size of the titanate compound particles be preferably within a range of 50 to 150 nm with respect that the effect thereof as a spacer is large, the friction force and adhesion force of the photoconductor/toner can be reduced, the transfer efficiency becomes satisfactory, the particles are more unlikely to be removed because of their high adhesion strength to the toner, and the particles are liberated into a lubricant memory.

It is preferable that the inorganic filler have a polymerizable group with respect that a protective layer having a high strength can be formed and thus wear of a photoconductor can be further reduced because the filler is present in a state of being chemically bonded with an integral polymer constituting the protective layer.

It is also preferable that the inorganic filler be composite particulates including a metal oxide attached on the surface of the core material with respect that an effect of reducing wear of the photoconductor or the cleaning blade and an effect of suppressing image defects can be further improved as well as transferability onto uneven paper can be further improved.

The electrophotographic image forming system of the present invention is an electrophotographic image forming system including an electrophotographic image forming apparatus having an electrophotographic photoconductor and a toner, wherein the electrophotographic photoconductor has a protective layer, the surface of the protective layer has a projection structure, the average distance between neighboring projections among a plurality of projections R is within the range of 100 to 250 nm, and the toner contains toner base particles including titanate compound particles attached thereto.

Accordingly, it is possible to provide an electrophotographic image forming system capable of suppressing the amount of a liberated external additive generated, reducing wear of a photoconductor and wear of a cleaning blade, and of suppressing image defects due to cleaning failure.

Hereinbelow, the present invention and components thereof and embodiments and aspects for implementing the present invention will be described. Note that the term "to" as used in the present application is used to mean ranges including the numerical values before and after "to" as the lower limit and the upper limit.

[Summary of Electrophotographic Image Forming Method of Present Invention]

The electrophotographic image forming method of the present invention is an electrophotographic image forming method using an electrophotographic photoconductor, wherein the electrophotographic photoconductor has a protective layer, the surface of the protective layer has a projection structure, the average distance between neighboring projections among a plurality of projections R is set within the range of 100 to 250 nm, and a toner including titanate compound particles attached to toner base particles is used.

The surface of the protective layer has a projection structure formed by rising of the inorganic filler. Herein, the "projection structure formed by rising of the inorganic filler" means a projection structure having an average height of 5 nm or more, constituted by an exposed inorganic filler.

The fact that the projection structure present on the surface of the protective layer is formed by rising of the inorganic filler can be confirmed by visually observing a photographic image of the surface of the protective layer imaged using a scanning electron microscope (SEM) "JSM-7401F" (manufactured by JEOL Ltd.).

<Average Distance between Projections R>

The average distance between projections of the projection structure formed by rising of the inorganic filler of the protective layer R (hereinbelow, also referred to as the "average distance between projections R") is calculated as follows.

Figure 3A:
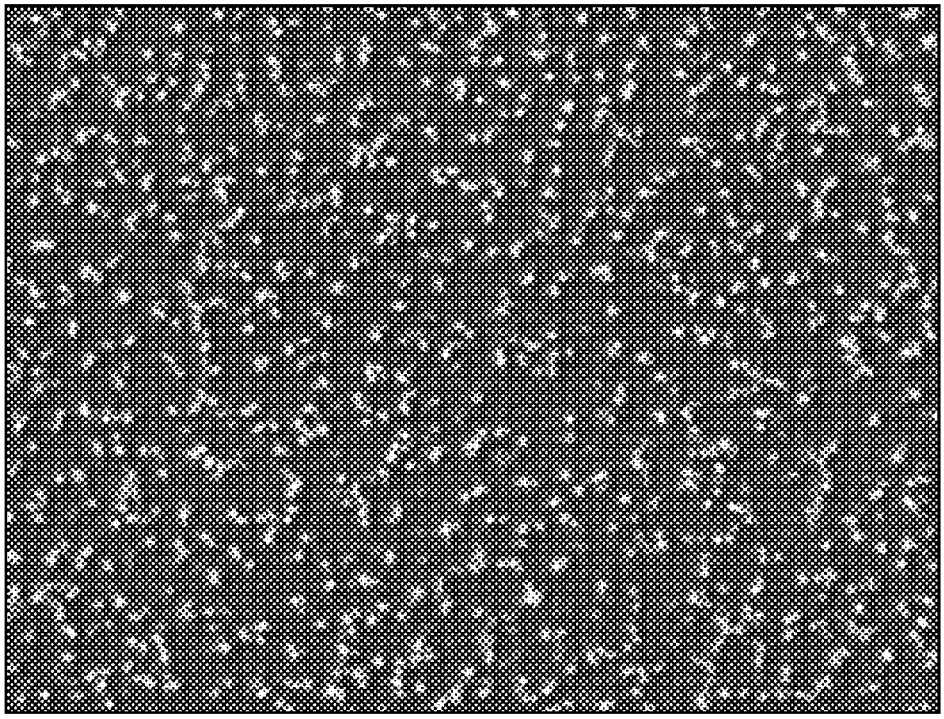
FIG. 3A is a photographic image of a projection structure formed by rising of an inorganic filler of a protective layer according to the present invention, imaged by a scanning electron microscope.
Figure 3B:
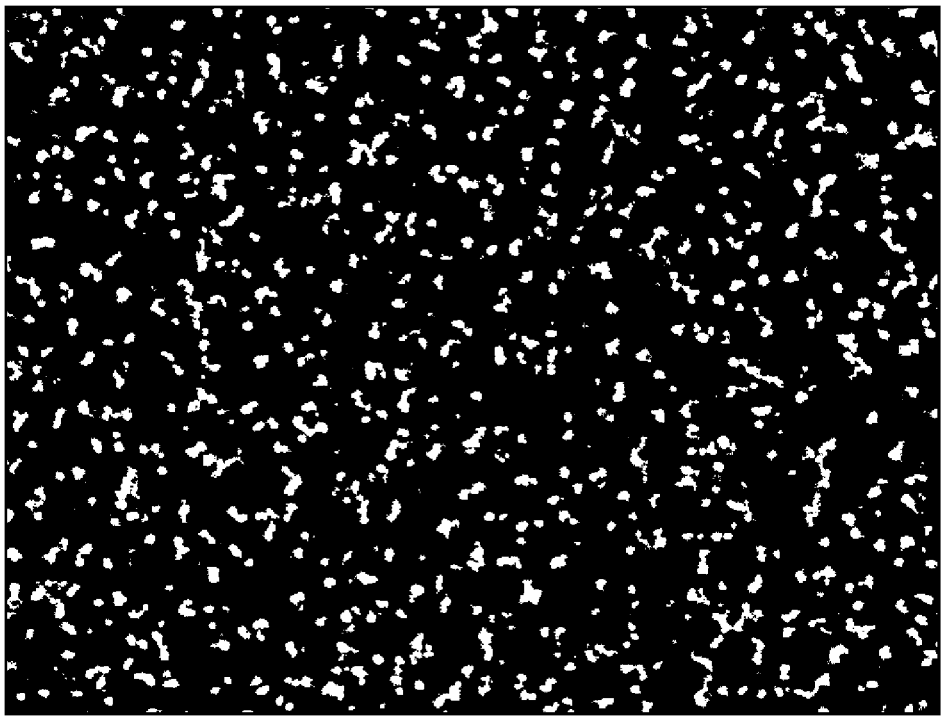
FIG. 3B is a binarized image of the photographic image of FIG. 3A.

First, a photographic image of the protective layer as the outermost layer imaged by a scanning electron microscope (SEM) "JSM-7401F" (manufactured by JEOL Ltd.) (acceleration voltage: 2.0 kV, magnification: 10000) is captured by a scanner. Next, an image processing analyzer ("LUZEX AP", manufactured by NIRECO CORPORATION) is used to binarize the photographic image obtained (see FIG. 3A) at a level of the maximum value of the monochrome histogram+30 (see FIG. 3A). Thereafter, measurement of the distribution of the distance between entire adjacent centroids as a measurement parameter of "LUZEX AP" is conducted, and the average value is taken as the average distance between projections of the projection structure formed by the rising of the inorganic filler of the outermost layer R.

The average distance between projections R according to the present invention is within the range of 100 to 250 nm, as mentioned above. The lower limit is preferably 120 nm or more. The upper limit is preferably 240 nm or less, more preferably 225 nm or less, even more preferably 200 nm or less.

Setting the average distance between projections R to 250 nm or less makes the projections uniform and dense, and when the toner comes in contact with the photoconductor surface, the toner comes in contact with the inorganic filler portion with a higher probability. Consequently, the remaining toner can be reliably and rapidly removed on cleaning Additionally, the remaining toner is more unlikely to pile in front of a blade nip, liberation and aggregation of the external additive caused by convection of the remaining toner in front of the blade nip are suppressed, and escape of the liberated external additive and aggregates thereof is also reduced. For this reason, also when an alumina external additive is used, wear and scratches of the photoconductor and the cleaning blade and cleaning failure related thereto are more unlikely to occur.

In order to shorten the average distance between projections formed of the inorganic filler R, raising the inorganic filler concentration is effective. However, with an excessive high inorganic filler concentration, the amount of the polymerization-cured resin portion relatively decreases, and thus, the crosslinking density is lowered. This makes the protective layer brittle, and photoconductor wear increases. From this reason, it is presumed that the average distance between projections formed of the inorganic filler R is required to be 100 nm or more.

The average height of the projections H (hereinbelow, also referred to as the "projection average height") is 5 nm or more, more preferably 15 nm or more, even more preferably 25 nm or more. With an average height within this range, the cleaning ability is further improved, and wear of the photoconductor is further reduced. This is presumed to be because an increase in the projection average height of the protective layer leads to a further reduction in wear of the protective layer caused by the cleaning blade and the probability of contact between the toner and the protective layer caused by contact between the external additive and the inorganic filler further increases.

The projection average height is not particularly limited, but is preferably 100 nm or less, more preferably 55 nm or less, even more preferably 35 nm or less (lower limit: 5 nm). With an average height within this range, the cleaning ability is further improved, and wear of the cleaning blade is further reduced. This is presumed to be because wear of the cleaning blade caused by the inorganic filler in the protective layer is more reduced as well as the cleaning blade sufficiently comes in contact with the resin portion of the polymerization-cured product constituting the protective layer.

The projection average height can be calculated by three-dimensionally measuring the surface of the outermost layer using a three-dimensional roughness analyzing scanning electron microscope "ERA-600FE" (manufactured by ELIONIX INC.), calculating the average height of contour curve elements in three-dimensional analysis, and taking the value as the projection average height of the protective layer.

Note that the projection average height is calculated on the basis of the surface portion, excluding the projections, of the protective layer surface.

Herein, the average distance between projections R and the projection average height H can be controlled by the type and content of the inorganic filler, the type, content, and presence/absence of surface modification of the polymerizable monomer, the type of the surface modifier, the type, particle size, and content of the inorganic filler, and the like.

Additionally, the average distance between projections R can be controlled to the optimal range by uniformly dispersing the inorganic filler in the protective layer without aggregation. As mentioned below, the inorganic filler can be uniformly dispersed in the protective layer by making the particle size of the inorganic filler, the presence/absence and type of surface modification, and the like appropriate.

[Electrophotographic Photoconductor]

In the electrophotographic image forming method of the present invention, an electrophotographic photoconductor (hereinbelow, simply referred to as a photoconductor) is used.

The electrophotographic photoconductor is an object carrying a latent image or a developed image on the surface thereof in an electrophotographic-type image forming method.

Preferable examples of the photoconductor include, but are not particularly limited to, photoconductors including a conductive support, a photosensitive layer disposed on the conductive support, and a protective layer disposed on the photosensitive layer, as the outermost layer.

The photoconductor may further include other constituents than the conductive support, the photosensitive layer, and the protective layer described above. Preferable examples of the other constituents include an intermediate layer and the like. The intermediate layer is, for example, a layer having a barrier function and an adhesion function to be disposed between the above conductive support and the above photosensitive layer.

An example of a preferable aspect of the photoconductor to be used in the present invention is a photoconductor including a conductive support, an intermediate layer disposed on the conductive support, a photosensitive layer disposed on the intermediate layer, and a protective layer disposed on the photosensitive layer, as the outermost layer.

Hereinbelow, an electrophotographic photoconductor having such constituents will be described in detail.

<Conductive Support>

The conductive support is a member that supports a photosensitive layer and has electrical conductivity. The shape of the conductive support is usually cylindrical. Preferable examples of the conductive support include metal drums or sheets, plastic films having a laminated metal foil, plastic films having a film of a vapor deposited conductive material, metal members, plastic films, and paper having a conductive layer formed by coating a paint composed of a conductive material or of a conductive material and a binder resin. Preferable examples of the metal described above include aluminum, copper, chromium, nickel, zinc, and stainless steel, and preferable examples of the conductive material include the above metals, indium oxide, and tin oxide.

<Photosensitive Layer>

The photosensitive layer is a layer for forming an electrostatic latent image of an intended image by means of light exposure mentioned below on the surface of the photoconductor. The photosensitive layer may be a single layer or may be composed of a plurality of laminated layers. Preferable examples of the photosensitive layer include single layers containing a charge transport material and a charge generation material and laminates of a charge transport layer containing a charge transport material and a charge generation layer containing a charge generation material.

<Protective Layer>

The protective layer is preferably a layer disposed as the outermost portion to be in contact with the toner. The protective layer is a layer for improving the mechanical strength of the photoconductor surface to thereby improve scratch resistance and wear resistance.

The protective layer according to the present invention preferably contains a polymerization-cured product of a composition containing a polymerizable monomer and an inorganic filler (hereinbelow, also referred to as a composition for forming protective layer).

(Inorganic Filler)

The composition for forming protective layer contains an inorganic filler. The inorganic filler herein refers to particles at least the surface of which is composed of an inorganic material. The inorganic filler has a function of improving the wear resistance of the protective layer. The inorganic filler also has a function of improving the removability of the remaining toner to improve cleaning ability and to reduce wear of the photoconductor and wear of the cleaning blade.

Hereinbelow, a surface modifier having a silicone chain is simply also referred to as a "silicone surface modifier", and surface modification by use of a "silicone surface modifier" is simply also referred to as "silicone surface modification".

A surface modifier having a polymerizable group is simply also referred to as a "reactive surface modifier", and surface modification by use of the "reactive surface modifier" is simply also referred to as "reactive surface modification".

Furthermore, an inorganic filler subjected to either one of "silicone surface modification" or "reactive surface modification" may be simply referred to as "surface-modified particles".

The inorganic filler preferably includes, but are not particularly limited to, metal oxide particles. Herein, metal oxide particles refer to particles at least surface of which (in the case of surface-modified particles, the surface of unmodified metal oxide particles as unmodified base particles) is composed of a metal oxide.

The shape of particles may be any of powder, spherical, rod, needle, plate, columnar, amorphous, scaly, spindle shapes and the like.

Examples of the metal oxide constituting the metal oxide particles include, but are not particularly limited to, silica (silicon oxide), magnesium oxide, zinc oxide, lead oxide, alumina (aluminum oxide), tin oxide, tantalum oxide, indium oxide, bismuth oxide, yttrium oxide, cobalt oxide, copper oxide, manganese oxide, selenium oxide, iron oxide, zirconium oxide, germanium oxide, titanium dioxide, niobium oxide, molybdenum oxide, vanadium oxide, and copper-aluminum oxide, and antimony-doped tin oxide.

Among these, alumina particles, silica ($SiO_2$) particles, tin oxide ($SnO_2$) particles, titanium dioxide ($TiO_2$) particles, antimony-doped tin oxide ($SnO_2$—Sb) particles, and copper-aluminum composite oxide ($CuAlO_2$) particles are preferable, and tin oxide particles are more preferable. One type of these metal oxide particles may be used singly, or two or more types of these may be used in combination.

The metal oxide particles are preferably composite particles of a core-shell structure having a core material (core) and an outer shell (shell) composed of a metal oxide.

When such composite particles are used, the property of transmitting active energy rays (in particular, ultraviolet rays) for use in curing of the protective layer is enhanced, the film strength of the protective layer after curing is improved, and wear of the protective layer is further reduced by choosing a core material (core) having a refractive index slightly different from that of the polymerizable monomer. It is also possible to further improve a surface-modifying effect in surface-modified particles mentioned below by selecting a material constituting the outer shell (shell) and controlling the shape of the outer shell (shell). Accordingly, an effect of reducing wear of the photoconductor or cleaning blade and an effect of suppressing image defects can be further improved as well as transferability onto uneven paper can be further improved.

Examples of the material constituting the core material (core) of the composite particles include, but are not particularly limited to, insulation materials such as barium sulfate ($BaSO_4$), alumina ($Al_2O_3$), and silica ($SiO_2$). Among these, from the viewpoint of maintaining the light transmission property of the protective layer, barium sulfate and silica are preferable. The material constituting the outer shell (shell) of the composite particles are similar to those exemplified as metal oxides constituting the metal oxide particles described above.

Preferable examples of the composite particles of a core-shell structure include composite particles of a core-shell structure having a core material composed of barium sulfate and an outer shell composed of tin oxide. Note that the ratio between the number average primary particle size of the core material and the thickness of the outer shell may be appropriately set such that a desired surface-modifying effect can be achieved in accordance with the type of the core material and outer shell to be used and the combination thereof.

The lower limit of the number average primary particle size of the inorganic filler is not particularly limited, but is more preferably 5 nm or more, even more preferably 10 nm or more, further even more preferably 50 nm or more, particularly preferably 80 nm or more. With a lower limit within this range, the cleaning ability is further improved, and wear of the photoconductor is further reduced.

The upper limit of the number average primary particle size of the inorganic filler is not particularly limited, but is preferably 700 nm or less, more preferably 500 nm or less, even more preferably 300 nm or less, further even more preferably 200 nm or less, particularly preferably 150 nm or less. With an upper limit within this range, the cleaning ability is further improved, and wear of the cleaning blade is further reduced. This is presumed to be because the average distance between projections of the projection structure R formed by rising of the inorganic filler of the protective layer can be controlled to an optimal range by controlling the number average primary particle size to the range described above.

Accordingly, as an example of a preferable aspect of the present invention, the number average primary particle size of the inorganic filler is within the range of 50 to 200 nm.

Note that the number average primary particle size of the inorganic filler herein is measured by the following method.

First, a photograph of the protective layer magnified at a magnification of 10000 times, imaged by a scanning electron microscope (manufactured by JEOL Ltd.), is captured by a scanner. Subsequently, from the photographic image obtained, images of 300 particles excluding aggregated particles are randomly binarized using an automatic image processing analyzing system LUZEX (registered trademark) AP software Ver. 1.32 (manufactured by NIRECO CORPORATION) to calculate the horizontal Feret's diameter of each particle image. Then, the average value of the horizontal Feret's diameter of each particle image is calculated and taken as the number average primary particle size.

Here, the horizontal Feret's diameter refers to the length of a side of the circumscribed rectangle on binarizing the above particle images, parallel to the x-axis. In the case of an inorganic filler having a polymerizable group and surface-modified particles mentioned below, measurement of the number average primary particle size of an inorganic filler is performed on an inorganic filler containing no chemical species having polymerizable group and containing no chemical species derived from the surface modifier (coating layer) (untreated base particles).

The inorganic filler in the composition for forming protective layer preferably has a polymerizable group. When the inorganic filler in the composition for forming protective layer has a polymerizable group, wear of the photoconductor is further reduced. This is presumed to be because the inorganic filler having a polymerizable group and the polymerizable monomer are brought into a chemically-bounded state in the cured product constituting the protective layer to thereby improve the film strength of the protective layer. The type of the polymerizable group is not particularly limited, but the polymerizable group is preferably a radically-polymerizable group. A method for introducing a polymerizable group is not particularly limited, but a method for surface-modifying the inorganic filler with a surface modifier having a polymerizable group, as mentioned below, is preferable.

The fact that the inorganic filler in the composition for forming protective layer has a polymerizable group and the fact that the inorganic filler in the protective layer has a group derived from a polymerizable group can be confirmed by thermogravimetric and thermal differential (TG/DTA) measurement, observation by a scanning electron microscope (SEM) or a transmission electron microscope (TEM), analysis by energy dispersive x-ray spectroscopy (EDX), and the like.

The preferable content of the inorganic filler in the composition for forming protective layer will be described in the description of the method for producing an electrophotographic photoconductor mentioned below.

The inorganic filler is preferably hydrophobized by use of a surface treating agent (surface modifier). The hydrophobization enables the inorganic filler to be uniformly dispersed in the protective layer at a high concentration without aggregation and enables the average distance between projections R to be controlled to an optimal range. As a hydrophobizing surface modifier, for example, a common coupling agent, a silane compound, a surface modifier having a silicone chain (a silicone surface treating agent or a silicone surface modifier), a fluorine-containing surface modifier, or the like can be used.

Surface Modification (Surface Treatment) by Surface Modifier Having Silicone Chain The inorganic filler is preferably surface-modified by use of a silicone surface modifier.

The silicone surface modifier preferably has a structural unit represented by the following formula (1).

[Formula 1]

Formula (1)

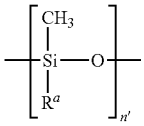

In the formula (1), $R^a$ represents a hydrogen atom or a methyl group, and n' is an integer of 3 or more.

The silicone surface modifier may be a silicone surface modifier having a silicone chain as the main chain (main chain-type silicone modifier (also referred to as a linear-type silicone modifier)) or may be a silicone surface modifier having a silicone chain as a side chain (a side chain-type silicone modifier), but is preferably a side chain-type silicone modifier. In other words, the inorganic filler is preferably surface-modified with a side chain-type silicone surface modifier.

When the inorganic filler is surface-modified with a side chain-type silicone modifier, the inorganic filler is efficiently hydrophobized, and silicone chains are present on the surface thereof at a high concentration. For this reason, the inorganic filler surface-modified with a side chain-type silicone modifier can be uniformly dispersed in the protective layer at a high concentration and is likely to expose its particle surface on the photoconductor surface. In other words, when a toner external additive comes in contact with the inorganic filler of the photoconductor, low friction and low adhesion can be achieved because silicone chains are present at a high concentration. The silicone modifier described above is also responsible for improving the dispersibility of the inorganic filler. Silicone surface-modifying the inorganic filler allows the inorganic filler to be uniformly present on the photoconductor surface to thereby enable a dense surface projection structure to be formed.

The side chain-type silicone surface modifier is not particularly limited and is preferably one having a silicone chain as a side chain of the polymeric main chain and additionally having a surface-modifying functional group. Examples of the surface-modifying functional group include groups that may bind to conductive metal oxide particles, such as carboxylic acid groups, a hydroxy group, —$R^d$—COOH ($R^d$ is a divalent hydrocarbon group), halogenated silyl groups, and alkoxysilyl groups. Among these, a carboxylic acid group, a hydroxy group, or an alkoxysilyl group is preferable, a hydroxy group or an alkoxysilyl group is more preferable.

The side chain-type silicone surface modifier preferably has a poly(meth)acrylate main chain or a silicone main chain as the polymeric main chain, from the viewpoints of maintaining the effects of the present invention and further reducing wear of the cleaning blade.

Silicone chains as the side chain and main chain preferably have dimethylsiloxane structures as repeating units, and the number of the repeating units is preferably 3 to 100, more preferably 3 to 50.

The weight average molecular weight of the silicone surface modifier is not particularly limited, but is preferably within the range of 1000 to 50000. Note that the weight average molecular weight of the silicone surface modifier can be measured by gel permeation chromatography (GPC).

The silicone surface modifier may be a synthesized product or may be a commercially available product. Specific examples of commercially available products of the main chain-type silicone surface modifier can include KF-99 and KF-9901 (both manufactured by Shin-Etsu Chemical Co., Ltd.).

Specific examples of commercially available products of the side chain-type silicone surface modifier having a silicone chain as a side chain of the poly(meth)acrylate main chain include SYMAC (registered trademark) US-350 (manufactured by Toagosei Co., Ltd.), KP-541, KP-574, and KP-578 (all manufactured by Shin-Etsu Chemical Co., Ltd.).

Then, specific examples of commercially available products of the side chain-type silicone surface modifier having a silicone chain as a side chain of the silicone main chain include KF-9908 and KF-9909 (both manufactured by Shin-Etsu Chemical Co., Ltd.). One of the silicone surface modifiers may be used singly, or two or more of them may be used in combination.

The surface modification method by use of a silicone surface modifier is not particularly limited, and is only required to be a method by which a silicone surface modifier can be attached (or bound) on the surface of the inorganic filler. Such methods are roughly divided into two types in general: a wet treatment method and a dry treatment method, but either of the methods may be used.

Note that, in case of silicone surface-modifying an inorganic filler after the reactive surface modification mentioned below, the surface modification method by use of a silicone surface modifier is only required to allow the silicone surface modifier to be attached (or bound) on the surface of the inorganic filler or on the reactive surface modifier.

The wet treatment method is a method of causing a silicone surface modifier to be attached (or bound) on the surface of the inorganic filler by dispersing the inorganic filler and the silicone surface modifier in a solvent. As the method, preferable is a method in which the inorganic filler and the silicone surface modifier are dispersed in a solvent and the dispersion obtained is dried to remove the solvent. More preferable is a method in which, after the method described above, the silicone surface modifier is caused to react with the inorganic filler by further performing a heat treatment to thereby cause the silicone surface modifier to be attached (bound) on the surface of the inorganic filler. Alternatively, after the silicone surface modifier and the inorganic filler are dispersed in a solvent, surface modification may be allowed to proceed while the inorganic filler may be finely divided by wet-pulverizing the dispersion obtained.

As a device that disperses the inorganic filler and the silicone surface modifier in a solvent, which is not particularly limited, and known devices can be used. Examples thereof include common dispersion devices such as homogenizers, ball mills, and sand mills.

As a solvent, which is not particularly limited, known solvents can be used. Preferable examples thereof include alcohol-based solvents such as methanol, ethanol, n-propanol, isopropanol, n-butanol, sec butanol (2-butanol), tert-butanol, and benzyl alcohol and aromatic hydrocarbon-based solvents such as toluene and xylene. One of these may be used singly, or two or more of these may be used in combination.

As a method of removing the solvent, which is not particularly limited, known methods can be used. Examples thereof include a method in which an evaporator is used and a method including evaporating the solvent at room temperature. Among these, the method including evaporating the solvent at room temperature is preferable.

The heating temperature is not particularly limited, but is preferably within the range of 50 to 250° C., more preferably within the range of 70 to 200° C., even more preferably within the range of 80 to 150° C. The heating time is not particularly limited, but is preferably within the range of 1 to 600 minutes, more preferably within the range of 10 to 300 minutes, even more preferably within the range of 30 to 90 minutes. Note that the heating method is not particularly limited and known methods can be used.

The dry treatment method is a method of causing the silicone surface modifier to be attached (or bound) on the surface of the inorganic filler by mixing and kneading the silicone surface modifier and the inorganic filler without using a solvent. The method may be a method in which, after the silicone surface modifier and the inorganic filler are mixed and kneaded, the silicone surface modifier is caused to react with the inorganic filler by further performing a heat treatment to thereby cause the silicone surface modifier to be attached (bound) on the surface of the inorganic filler. Alternatively, when the inorganic filler and the silicone surface modifier are mixed and kneaded, surface modification may be allowed to proceed while the inorganic filler is finely divided by dry-pulverizing the inorganic filler and the silicone surface modifier.

The amount of the silicone surface modifier to be used is preferably 0.1 parts by mass or more, more preferably 1 part by mass or more, even more preferably 2 parts by mass or more, based on 100 parts by mass of the inorganic filler before silicone surface modification (the inorganic filler after reactive surface modification in the case of silicone surface-modifying the inorganic filler after the reactive surface modification mentioned below). With an amount to be used within this range, the cleaning ability is further improved, and wear of the cleaning blade is further reduced.

Additionally, the amount of the silicone surface modifier to be used is preferably 100 parts by mass or less, more preferably 10 parts by mass or less, even more preferably 5 parts by mass or less, based on 100 parts by mass of the inorganic filler before silicone surface modification (the inorganic filler after reactive surface modification in the case of silicone surface-modifying the inorganic filler after the reactive surface modification mentioned below). With an amount to be used within this range, a decrease in the membrane strength of the protective layer caused by the unreacted silicone surface modifier is suppressed, and wear of the photoconductor is further reduced.

The fact that the unmodified inorganic filler or the inorganic filler after reactive surface modification has been subjected to silicone surface modification can be confirmed by thermogravimetric and thermal differential (TG/DTA) measurement, observation by a scanning electron microscope (SEM) or transmission electron microscope (TEM), analysis by energy dispersive x-ray spectroscopy (EDX), and the like.

Surface Modification Method by Use of Fluorine-Containing Surface Modifier

A fluorine-containing surface modifier has a fluorine-containing group and a surface-treating functional group.

Examples of the fluorine-containing group include perfluoroalkyl groups and perfluoropolyether groups.

Examples of the surface-treating functional group include carboxylic acid groups, a hydroxy group, and alkoxysilyl groups.

The fluorine-containing surface modifier described above is preferably one having a fluoroalkyl (meth)acrylate/(meth) acrylic acid copolymer structure, more preferably one having both a structural unit represented by the following general formula (1a) and a structural unit represented by the general formula (1b).

[Formula 2]

General formula (1a)

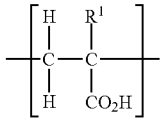

General formula (1b)

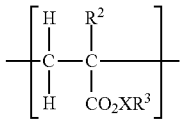

In the general formula (1a) described above, R' is a hydrogen atom or a methyl group.

In the general formula (1b) described above, 1V is a linear or branched alkyl group having 1 to 4 carbon atoms, X is an alkylene group having 1 to 4 carbon atoms, and $R^3$ is a perfluoroalkyl group having 1 to 6 carbon atoms.

Use of a fluorine-containing surface modifier having both a structural unit represented by the following general formula (1a) and a structural unit represented by the general formula (1b) enables the fluorine-containing surface modifier to be present on the surface of the inorganic filler with high adhesion to thereby provide a high fluorine density.

Additionally, the inorganic filler having the fluorine-containing surface modifier exhibits satisfactory dispersibility in a coating solution for protective layer, and thus, excellent dispersibility can be provided in a coated film.

The molecular weight of the fluorine-containing surface modifier as the number average molecule weight is preferably within the range of 5000 to 30000.

As the fluorine-containing surface modifier, for example, a 2,2,3,3,4,4,4-heptafluorobutyl methacrylate/acrylic acid copolymer, a 2,2,3,3-tetrafluoropropyl methacrylate/methacrylic acid copolymer, and a 2,2,3,3,4,4,5,5,5-nonafluoropentyl methacrylate/acrylic acid copolymer can be used. One of these may be used singly, or two or more of these may be used as a mixture.

The amount of the fluorine-containing surface modifier to be used is preferably within the range of 0.5 to 20 parts by mass, more preferably within the range of 1 to 10 parts by mass, based on 100 parts by mass of the unmodified inorganic filler.

The fact that the inorganic filler has been subjected to surface modification by use of the fluorine-containing surface modifier can be confirmed by thermal differential and thermogravimetric (TG/DTA) measurement.

Surface Modification Method by Use of Surface Modifier Having Polymerizable Group (Reactive Surface Modifier)

As mentioned above, the inorganic filler in the composition for forming protective layer preferably has a polymerizable group. Then, a method for introducing the polymerizable group is not particularly limited, but is preferably a method for performing reactive surface modification.

In other words, the inorganic filler is preferably surface-modified (reactive surface-modified) with a surface modifier having a polymerizable group (reactive surface modifier). The polymerizable group is carried on the surface of conductive metal oxide particles via the reactive surface modification. As a result, the inorganic filler has the polymerizable group. Note that, as an example of a preferable aspect of the present invention, the inorganic filler has a group derived from the polymerizable group because the inorganic filler is to be present as a structure having the group derived from the polymerizable group in the protective layer.

A reactive surface modifier has a polymerizable group and a surface-modifying functional group. The type of the polymerizable group is not particularly limited, but the polymerizable group is preferably a radically-polymerizable group. Here, the radically-polymerizable group represents a group that can be radically polymerized, the group having a carbon-carbon double bond. Examples of the radically-polymerizable group include a vinyl group and (meth) acryloyl groups. Among these, a methacryloyl groups are preferable. The surface-modifying functional group represents a group that has reactivity to polar groups, such as a hydroxy group present on the surface of conductive metal oxide particles. Examples of the surface-modifying functional group include carboxylic acid groups, a hydroxy group, —$R^{d1}$—COOH ($R^{d1}$ is a divalent hydrocarbon group), halogenated silyl groups, and alkoxysilyl groups. Among these, halogenated silyl groups and alkoxysilyl groups are preferable.

The reactive surface modifier is preferably a silane coupling agent having a radically-polymerizable group, and examples thereof include compounds represented by the following formulas S-1 to S-32.

$CH_2{=}CHSi(CH_3)(OCH_3)_2$ S-1:

$CH_2{=}CHSi(OCH_3)_3$ S-2:

$CH_2{=}CHSiCl_3$ S-3:

$CH_2{=}CHCOO(CH_2)_2Si(CH_3)(OCH_3)_2$ S-4:

$CH_2{=}CHCOO(CH_2)_2Si(OCH_3)_3$ S-5:

$CH_2{=}CHCOO(CH_2)_2Si(OC_2H_5)(OCH_3)_2$ S-6:

$CH_2{=}CHCOO(CH_2)_3Si(OCH_3)_3$ S-7:

$CH_2{=}CHCOO(CH_2)_2Si(CH_3)Cl_2$ S-8:

$CH_2{=}CHCOO(CH_2)_2SiCl_3$ S-9:

$CH_2{=}CHCOO(CH_2)_3Si(CH_3)Cl_2$ S-10:

$CH_2{=}CHCOO(CH_2)_3SiCl_3$ S-11:

$CH_2{=}C(CH_3)COO(CH_2)_2Si(CH_3)(OCH_3)_2$ S-12:

$CH_2{=}C(CH_3)COO(CH_2)_2Si(OCH_3)_3$ S-13:

$CH_2{=}C(CH_3)COO(CH_2)_3Si(CH_3)(OCH_3)_2$ S-14:

$CH_2{=}C(CH_3)COO(CH_2)_3Si(OCH_3)_3$ S-15:

$CH_2{=}C(CH_3)COO(CH_2)_2Si(CH_3)Cl_2$ S-16:

$CH_2{=}C(CH_3)COO(CH_2)_2SiCl_3$ S-17:

$CH_2{=}C(CH_3)COO(CH_2)_3Si(CH_3)Cl_2$ S-18:

$CH_2{=}C(CH_3)COO(CH_2)_3SiCl_3$ S-19:

$CH_2{=}CHSi(C_2H_5)(OCH_3)_2$ S-20:

$CH_2{=}C(CH_3)Si(OCH_3)_3$ S-21:

$CH_2{=}C(CH_3)Si(OC_2H_5)_3$ S-22:

$CH_2{=}CHSi(OCH_3)_3$ S-23:

$CH_2{=}C(CH_3)Si(CH_3)(OCH_3)_2$ S-24:

$CH_2{=}CHSi(CH_3)Cl_2$ S-25:

$CH_2{=}CHCOOSi(OCH_3)_3$ S-26:

$CH_2{=}CHCOOSi(OC_2H_5)_3$ S-27:

$CH_2{=}C(CH_3)COOSi(OCH_3)_3$ S-28:

$CH_2{=}C(CH_3)COOSi(OC_2H_5)_3$ S-29:

$CH_2{=}C(CH_3)COO(CH_2)_3Si(OC_2H_5)_3$ S-30:

$CH_2{=}CHCOO(CH_2)_2Si(CH_3)_2(OCH_3)$ S-31:

$CH_2{=}C(CH_3)COO(CH_2)_8Si(OCH_3)_3$ S-32:

The reactive surface modifier may be a synthesized product or may be a commercially available product. Specific examples of commercially available products include KBM-502, KBM-503, KBE-502, KBE-503, and KBM-5103 (all produced by Shin-Etsu Chemical Co., Ltd.). One of these reactive surface modifier may be used singly, or two or more of them may be used in combination.

When both silicone surface modification and reactive surface modification are performed, it is preferable that the reactive surface modification be performed followed by the silicone surface modification. The wear resistance of the protective layer is further improved by performing the surface modifications in this order. This is because the reactive surface modifier is not prevented from coming into contact with the inorganic filler surface by silicone chains, which have an oil repellent effect, and thus, the polymerizable group is efficiently introduced to the inorganic filler.

The reactive surface modification method is not particularly limited, and it is possible to employ a method same as the method described for the silicone surface modification except that a reactive surface modifier is used. It is also possible to use known surface modification techniques for metal oxide particles.

Here, when a wet treatment method is used, solvents same as those for the method described for the silicone surface modification are preferably used.

The amount of the reactive surface modifier to be used is preferably 0.5 parts by mass or more, more preferably 1 part by mass or more, even more preferably 1.5 parts by mass or more, based on 100 parts by mass of the inorganic filler before silicone surface modification (the inorganic filler after silicone surface modification in the case of reactive surface-modifying the inorganic filler after the silicone surface modification mentioned above).

With an amount to be used within this range, the membrane strength of the protective layer is improved, and wear of the photoconductor is further reduced. Additionally, the amount to be used is preferably 15 parts by mass or less, more preferably 10 parts by mass or less, even more preferably 8 parts by mass or less, based on 100 parts by mass of the inorganic filler before reactive surface modification (the inorganic filler after the silicone surface modification in the case of reactive surface-modifying the inorganic filler after the silicone surface modification mentioned above). With an amount to be used within this range, the amount of the reactive surface modifier does not become excessive relative to the number of hydroxy groups on the particle surface and falls within a more appropriate range. A decrease in the membrane strength of the protective layer due to the unreacted reactive surface modifier is suppressed to thereby enhance the membrane strength of the protective layer, and thus, wear of the photoconductor is further reduced.

(Polymerizable Monomer)

The composition for forming protective layer contains a polymerizable monomer. Herein, the polymerizable monomer represents a compound having a polymerizable group that is polymerized (cured) by irradiation with an active energy ray such as an ultraviolet ray, a visible light ray, and an electron beam or by addition of energy such as heating to thereby become a binder resin of the protective layer. Note that, in the polymerizable monomer referred to herein, the reactive surface modifier described above is not included. When a polymerizable silicone compound or a polymerizable perfluoropolyether compound as the lubricant mentioned below is used, such compounds also are not included.

The type of the polymerizable group possessed by the polymerizable monomer is not particularly limited, but the polymerizable group is preferably a radically-polymerizable group. Here, the radically-polymerizable group represents a group that can be radically polymerized, the group having a carbon-carbon double bond. Examples of the radically-polymerizable group include vinyl groups and (meth)acryloyl groups, and (meth)acryloyl groups are preferable. When the polymerizable group is a (meth)acryloyl group, the wear resistance of the protective layer is improved, and wear of the photoconductor is further reduced. It is presumed that the reason why the wear resistance of the protective layer is improved is that efficient curing is enabled with a small amount of light or in a short period of time.

Examples of the polymerizable monomer include styrenic monomers, (meth)acrylic monomers, vinyl toluene-based monomer, vinyl acetate-based monomers, and N-vinyl pyrrolidone-based monomers. One of these polymerizable monomer may be used singly, or two or more of these may be used as a mixture.

The number of polymerizable groups per molecule possessed by the polymerizable monomer is not particularly limited, but is preferably two or more, more preferably 3 or more. With the number of polymerizable groups within this range, the wear resistance of the protective layer is improved, and wear of the photoconductor is further reduced. It is presumed that this is because the crosslinking density of the protective layer increases and the membrane strength is further enhanced. Additionally, number of polymerizable groups per molecule possessed by the polymerizable monomer is not particularly limited, but is preferably 6 or less, more preferably 5 or less, even more preferably 4 or less. With the number of polymerizable groups within this range, the uniformity of the protective layer increases. It is presumed that this is because the crosslinking density falls below a certain density and cure shrinkage is more unlikely to occur. From these viewpoints, the number of polymerizable groups per molecule possessed by the polymerizable monomer is most preferably three.

Specific examples of the polymerizable monomer include, but are not particularly limited to, the following compounds M1 to M11. Among these, the following compound M2 is particularly preferable. In each of the following formulas, R represents an acryloyl group ($CH_2{=}CHCO{-}$), and R' represents a methacryloyl group ($CH_2{=}C(CH_3)CO{-}$).

[Formula 3]

M1

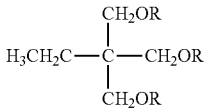

M2

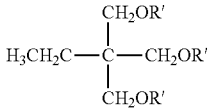

M3

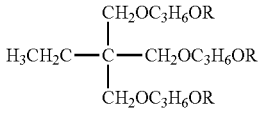

M4

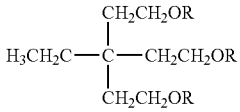

M5

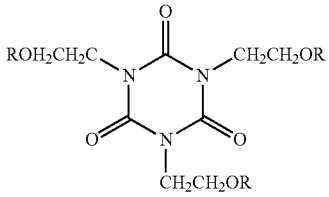

M6

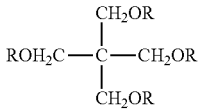

M7

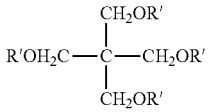

M8

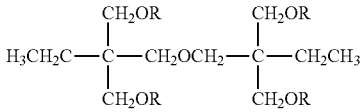

M9

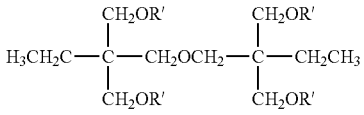

M10

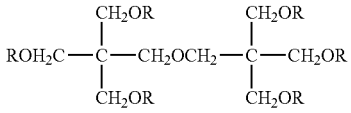

M11

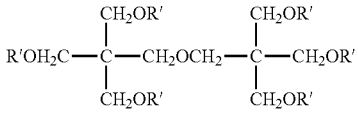

The polymerizable monomer may be a synthesized product or may be a commercially available product. One of such polymerizable monomers may be used singly, or two or more of these may be used in combination.

The preferable content of the polymerizable monomer in the composition for forming protective layer will be described in the description of the method for producing an electrophotographic photoconductor mentioned below.

(Photopolymerization Initiator)

The composition for forming protective layer preferably further contains a polymerization initiator.

The polymerization initiator is used in a process of producing a cured resin (binder resin) to be provided by polymerizing the polymerizable monomer described above. The polymerization initiator may be a heat polymerization initiator or may be a photopolymerization initiator, but is preferably a photopolymerization initiator. When the polymerizable monomer is a radically-polymerizable monomer, the initiator is preferably a radical polymerization initiator.

The radical polymerization initiator is not particularly limited, and known ones may be used. Examples thereof include alkylphenone-based compounds and phosphine oxide-based compounds. Among these, compounds having an α-aminoalkylphenone structure or acylphosphine oxide structure are preferable, and compounds having an acylphosphine oxide structure are more preferable. An example of the compounds having an acylphosphine oxide structure is IRGACURE (registered trademark) 819 (bis(2,4,6-trimethylbenzoyl)phenylphosphine oxide) (BASF Japan Ltd.).

One of the polymerization initiators may be used singly, or two or more of these may be used in combination.

The preferable content of the polymerization initiator in the composition for forming protective layer will be described in the description of the method for an electrophotographic photoconductor mentioned below.

(Other Components)

The composition for forming protective layer may additionally contain other components than the components described above.

Examples of the other components include, but are not particularly limited to, lubricants. The charge transport material is not particularly limited, and known ones may be used. Examples thereof include triarylamine derivatives. The lubricant is not particularly limited, and known ones may be used. Examples thereof include polymerizable silicone compounds and polymerizable perfluoropolyether compounds.

(Thickness of Protective Layer)

For the thickness of the protective layer, a preferable value can be appropriately set in accordance with the type of the photoconductor. The thickness is not particularly limited, but is preferably within the range of 0.2 to 15 μm, more preferably within the range of 0.5 to 10 μm, in a common photoconductor.

[Method for Producing Electrophotographic Photoconductor]

An electrophotographic photoconductor to be used in one aspect of the present invention can be produced by known methods for producing an electrophotographic photoconductor without particular limitation as long as the coating liquid for forming protective layer mentioned below is used. Among these, the electrophotographic photoconductor is preferably produced by a method including a step of coating a coating liquid for forming protective layer on the surface of a photosensitive layer formed on a conductive support and a step of irradiating the coated coating liquid for forming protective layer with an active energy ray or heating the coated coating liquid for forming protective layer to polymerize the polymerizable monomer in the coating liquid for forming protective layer. A method including a step of coating a coating liquid for forming protective layer and a step of irradiating the coated coating liquid for forming protective layer with an active energy ray to polymerize a polymerizable monomer in the coating liquid for forming protective layer is more preferable.

The coating liquid for forming protective layer contains a composition for forming protective layer containing a polymerizable monomer and an inorganic filler. The composition for forming protective layer preferably further contains a polymerization initiator and may further contain other components than these components. The coating liquid for forming protective layer preferably contains a composition for forming protective layer and a dispersion medium. Note that, herein, the composition for forming protective layer does not contain a compound that is used only as a dispersion medium.

The dispersion medium is not particularly limited, and known ones may be used. Examples thereof include methanol, ethanol, n-propyl alcohol, isopropyl alcohol, n-butanol, tert-butanol, 2-butanol (sec-butanol), benzyl alcohol, toluene, xylene, methyl ethyl ketone, cyclohexane, ethyl acetate, butyl acetate, methyl cellosolve, ethyl cellosolve, tetrahydrofuran, 1,3-dioxane, 1,3-dioxolane, pyridine, and diethylamine One of the dispersion media may be used singly, or two or more of these may be used in combination.

The content of the dispersion medium based on the total mass of the coating liquid for forming protective layer is not particularly limited, but is preferably within the range of 1 to 99% by mass, more preferably within the range of 40 to 90% by mass, even more preferably within the range of 50 to 80% by mass.

The content of the inorganic filler in the composition for forming protective layer is not particularly limited, but is preferably 20% by mass or more, more preferably 30% by mass or more, even more preferably 40% by mass or more, based on the total mass of the composition for forming protective layer. With a content within this range, the wear resistance of the protective layer is improved, and wear of the photoconductor is further reduced. As the content of the inorganic filler increases, the effect caused by the particles is improved, the cleaning ability is enhanced, and wear of the cleaning blade is also further reduced. Additionally, the content of the inorganic filler in the composition for forming protective layer is not particularly limited, but is preferably 90% by mass or less, more preferably 80% by mass or less, even more preferably 70% by mass or less, based on the total mass of the composition for forming protective layer. With a content within this range, the content of the polymerizable monomer in the composition for forming protective layer is relatively high. Thus, the crosslinking density of the protective layer is enhanced, the wear resistance is improved, and wear of the photoconductor is further reduced. Additionally, the cleaning blade sufficiently comes in contact with the resin portion of the polymerization-cured product constituting the protective layer, and the cleaning ability is improved. Additionally, as a result of these, wear of the cleaning blade is further reduced.

The content ratio by mass of the polymerizable monomer to that of the inorganic filler in the composition for forming protective layer (mass of the polymerizable monomer/mass of the inorganic filler in the composition for forming protective layer) is not particularly limited, but is preferably 0.1 or more, more preferably 0.2 or more, even more preferably 0.4 or more. With a content ratio within this range, the content of the polymerizable monomer in the composition for forming protective layer is relatively high. Thus, the crosslinking density of the protective layer is enhanced, the wear resistance is improved, and depletion of the photoconductor is further reduced. Additionally, the cleaning blade sufficiently comes in contact with the resin portion of the polymerization-cured product constituting the protective layer, and the cleaning ability is improved. Additionally, as a result of these, wear of the cleaning blade is further reduced. Alternatively, the content ratio by mass of the polymerizable monomer to that of the inorganic filler in the composition for forming protective layer is not particularly limited, but is preferably 10 or less, more preferably 2 or less, further more preferably 1.5 or less. With a content ratio within this range, the wear resistance of the protective layer is improved and depletion of the photoconductor is reduced. As the content of the inorganic filler increases, the effect caused by the particles is improved, the cleaning ability is enhanced, and wear of the cleaning blade is also further reduced.

When the composition for forming protective layer contains a polymerization initiator, the content of the initiator is not particularly limited, but is preferably 0.1 parts by mass or more, more preferably 1 part by mass or more, further more preferably 5 parts by mass or more, based on 100 parts by mass of the polymerizable monomer. Additionally, the content of the polymerization initiator in the composition for forming protective layer is not particularly limited, but is preferably 30 parts by mass or less, more preferably 20 parts by mass or less, based on 100 parts by mass of the polymerizable monomer. Within a content within this range, the crosslinking density of the protective layer is enhanced, the wear resistance of the protective layer is improved, and wear of the photoconductor is further reduced.

Note that the content of the inorganic filler, the cured product of the polymerizable monomer, and the polymerization initiator and other components optionally used based on the total mass of the protective layer (% by mass) (in the case where the components each have polymerizability, cured products thereof are included) will be substantially equivalent to the content of the inorganic filler, the polymerizable monomer, and the polymerization initiator and other components optionally used based on the total mass of the composition for forming protective layer (% by mass).

The method for preparing the coating liquid for forming protective layer is also not particularly limited, and it is only required to add a polymerizable monomer, an inorganic filler, and a polymerization initiator and other components optionally used to a dispersion medium and to stir and mix the components until dissolution or dispersion.

The protective layer can be formed by coating the coating liquid for forming protective layer prepared by the method described above on the photosensitive layer and then drying and curing the coated liquid.

During the process of the coating, drying, and curing described above, reaction between polymerizable monomer molecules; and further in the case where the inorganic filler has a polymerizable group, reaction between a polymerizable monomer molecule and an inorganic filler particle, and reaction between inorganic filler particles, and the like proceed to thereby form a protective layer including a cured product of the composition for forming protective layer.

The method for coating the coating liquid for forming protective layer is not particularly limited, and it is possible to use a known method such as a dip coating method, a spray coating method, a spinner coating method, a bead coating method, a blade coating method, a beam coating method, a slide hopper coating method, and a round slide hopper coating method.

After the coating liquid described above is coated, it is preferable that the liquid be air-dried or heat-dried to form a coated film and then, the coated film be cured by irradiation with an active energy ray. As the active energy ray, an ultraviolet ray and an electron beam preferable, an ultraviolet ray is more preferable.

As an ultraviolet light source, any light source that emits an ultraviolet ray can be used without limitation. For example, a low-pressure mercury lamp, a medium-pressure mercury lamp, a high-pressure mercury lamp, an ultrahigh-pressure mercury lamp, a carbon arc lamp, a metal halide lamp, a xenon lamp, a flash (pulse) xenon lamp, or the like can be used. The irradiation conditions depend on each lamp, but the irradiation dose of an ultraviolet ray (integrated light intensity) is preferably 5 to 5000 mJ/cm$^2$, more preferably 10 to 2000 mJ/cm$^2$. The illuminance of an ultraviolet ray is preferably 5 to 500 mW/cm$^2$, more preferably 10 to 100 mW/cm$^2$.

The irradiation time for achieving the required irradiation dose (integrated light intensity) of an active energy ray is preferably 0.1 seconds to 10 minutes, more preferably 0.1 seconds to 5 minutes from the view point of working efficiency.

In the process of forming the protective layer, drying can be performed before or after irradiation with an active energy ray or during irradiation with an active energy ray. The timing for performing drying can be appropriately selected with these combined.

The drying conditions can be appropriately selected in accordance with the type of the solvent, film thickness, and the like. The drying temperature is not particularly limited, but is preferably 20 to 180° C., more preferably 80 to 140° C. The drying time is not particularly limited, but is preferably 1 to 200 minutes, more preferably 5 to 100 minutes.

In the protective layer, the polymerizable monomer constitutes a polymerized product (polymerization-cured product). Here, in the case where the inorganic filler has a polymerizable group, the polymerizable monomer and the inorganic filler having a polymerizable group in the protective layer constitute an integral polymerized product (polymerization-cured product) that forms the protective layer. That fact that the polymerization-cured product is a polymerized product (polymerization-cured product) of the polymerizable monomer or a polymerized product (polymerization-cured product) of the polymerizable monomer and the inorganic filler having a polymerizable group can be confirmed with analysis of the polymerized product (polymerization-cured product) described above by means of a known instrument analysis technique such as pyrolysis GC-MS, nuclear magnetic resonance (NMR), a Fourier transform infrared spectrometer (FT-IR), or element analysis.

[Toner]

In the image forming method and image formation system of the present invention, a toner contains toner base particles and at least titanate compound particles as an external additive externally added to the toner base particles.

Herein, the "toner base particles" constitute the base of the "toner particles". The "toner base particles" contains at a least binder resin and may other constituents such as a colorant, a release agent (wax), and a charge control agent, as required. The "toner base particles" are referred to as toner particles after addition of an external additive. The "toner" refers to an assembly of the "toner particles".

<Toner Base Particles>

The composition and structure of the toner base particles are not particularly limited, and known toner base particles can be appropriately employed. Examples include toner base particles described in JP 2018-72694A and JP 2018-84645A.

Examples of the binder resin include, but are not particularly limited to, amorphous resins and crystalline resins. Herein, an amorphous resin refers to a resin having no melting point and having a relatively high glass-transition temperature (Tg) when subjected to differential scanning calorimetry (DSC). The amorphous resin is not particularly limited, and known amorphous resins can be used. Examples thereof include vinyl resins, amorphous polyester resins, urethane resins, and urea resins. Among these, vinyl resins are preferable from the viewpoint of their easily controllable thermoplasticity.

The vinyl resin is not particularly limited as long as the vinyl resin is one obtained by polymerizing a vinyl compound. Examples thereof include (meth)acrylate resins, styrene-(meth)acrylate resins, and ethylene-vinyl acetate resins.

Herein, a crystalline resin refers to a resin having a definite endothermic peak rather than a stepwise endothermic change in differential scanning calorimetry (DSC). The definite endothermic peak specifically means a peak of which half width is 15° C. or less as measured by differential scanning calorimetry (DSC) at a temperature rise rate of 10° C./minute.

The crystalline resin is not particularly limited, and a known crystalline resin can be used. Examples thereof include crystalline polyester resins, crystalline polyurethane resins, crystalline polyurea resins, crystalline polyamide resins, and crystalline polyether resins. Among these, a crystalline polyester resin is preferably used. Here, the "crystalline polyester resin" is a resin that satisfies the endothermic properties described above, among known polyester resins obtained by polycondensation reaction between a divalent or higher carboxylic acid (polyvalent carboxylic acid) or derivative thereof and a divalent or higher alcohol (polyhydric alcohol) or derivative thereof. One of these resins may be used singly, or two or more these may be used in combination.

The colorant is not particularly limited, and a known colorant can be used. Examples thereof include carbon black, magnetic materials, dyes, and pigments.

The release agent is not particularly limited, and a known release agent can be used. Examples thereof include polyolefin waxes, branched hydrocarbon waxes, long-chain hydrocarbon-based waxes, dialkylketone-based waxes, ester-based waxes, and amide-based waxes.

The charge control agent is not particularly limited, and a known charge control agent can be used. Examples thereof include nigrosine-based dyes, metal salts of naphthenic acid or higher fatty acids, alkoxylated amines, quaternary ammonium salt compounds, azo-based metal complexes, metal salts of salicyclic acid, and metal complexes.

The toner base particles may be toner particles of a multi-layer structure such as a core-shell structure including a core particle and a shell layer with which the surface of the core particle is covered. The surface of the core particle may not be entirely covered with the shell layer, and the core particle may be partially exposed. The cross section of the core-shell structure can be observed with a known observation device such as a transmission electron microscope (TEM), a scanning probe microscope (SPM), or the like.

The volume average particle size of the toner particles is preferably within the range of 3.0 to 6.5 μm. From the viewpoint of ease of production, the volume average particle size of the toner particles is set to 3.0 μm or more. From the viewpoint of enabling image defects due to components having a low amount of charge to be unlikely to occur without making the amount of charge excessively low, the volume average particle size of the toner particles is preferably set to 6.5 μm or less.

The average circularity of the toner particles is preferably 0.995 or less, more preferably 0.985 or less, even more preferably within the range of 0.93 to 0.97. With an average circularity within the range like this, the toner particles are more likely to be charged.

<External Additive>

An external additive include metal oxide particles. Metal oxide particles as an external additive have a function of reducing electrostatic and physical adhesion force between a transfer member and the toner to thereby improve transferability. The inorganic filler also has a function of improving the removability of the remaining toner to improve cleaning ability and to reduce wear of the photoconductor and wear of the cleaning blade.

(Titanate Compound Particles)

In the toner according to the present invention, titanate compound particles are used as the external additive.

Examples of the titanate compound particles include calcium titanate particles, strontium titanate particles, and zinc titanate particles. In respect of maintaining the amount of charge at a constant level over a long period, calcium titanate particles or strontium titanate particles are preferable.

The titanate compound particles can be produced by known methods.

An example of a method for producing a titanate compound that can be used in the present invention is a method in which such a titanate compound is produced by use of titanium oxide(IV) compound $TiO_2$—$HO_2O$, which is called metatitanic acid and has a form of hydrate. This method is a method for producing a titanate compound including calcium titanate by allowing the titanium oxide(IV) compound to react with a metal carbonate such as calcium carbonate or a metal oxide and then to be subjected to firing. Note that hydrolysates of titanium oxides such as metatitanic acid are also referred to as mineral acid peptized products, having a form of liquid in which titanium oxide particles are dispersed. The titanate compound is produced by adding a water-soluble metal carbonate or metal oxide to a mineral acid peptized product composed of this titanium oxide hydrolysate, heating the mixed liquid to 50° C. or more, and causing the liquid to react while an alkali aqueous solution is added thereto.

The number average primary particle size of the titanate compound particles is preferably within the range of 50 to 150 nm. With a number average primary particle size within this range, 50 nm or more, the effect of the particles as a spacer is large, the friction force and adhesion force between the photoconductor/toner can be reduced, and the transfer efficiency becomes satisfactory. The number average primary particle size of 150 nm or less is preferable with respect that the particles are more unlikely to be removed because of their high adhesion strength to the toner and the particles are liberated into a lubricant memory.

The number average particle size of the titanate compound particles can be measured as follows.

An SEM photograph magnified at a magnification of 50000 times using a scanning electron microscope (SEM) "JSM-7401F" (manufactured by JEOL Ltd.) is captured by a scanner. The titanate compound particles of the SEM photographic image are binarized by an image processing analyzer ("LUZEX AP", manufactured by NIRECO CORPORATION), and the Feret's diameter in the horizontal direction of each of 100 particles among the titanate compound particles is calculated. The average value of the diameters is taken as the number average particle size.

The surface of the titanate compound particles is preferably hydrophobized with a surface modifier (surface treating agent), and the degree of hydrophobization is preferably within the range of 40 to 70, for example. This makes it possible to more effectively suppress variation in the amount of charge due to environmental differences and variation in the amount of charge on transferring to the carrier. The ratio of the surface modifier liberated when hydrophobized is preferably 0. When the surface modifier liberated is present, the modifier migrates to the carrier, and thus variation in the amount of charge increases.

Examples of methods for hydrophobizing titanate compound particles by use of a surface modifier include dry methods such as a spray dry method in which titanate compound particles suspended in gas phase are sprayed with a surface modifier or a solution containing the surface modifier, wet methods in which titanate compound particles are immersed in a solution containing a surface modifier and then dried, and a mix method in which a surface modifier and titanate compound particles are mixed by means of a mixer.

The content of the titanate compound particles is preferably, for example, within the range of 0.1 to 2.0 parts by mass based on 100 parts by mass of the toner base particles. With a content of 0.1 parts by mass or more, the effects of the present invention can be more reliably achieved. With a content of 2.0 parts by mass or less, it is possible to suppress a probability that the titanate compound particles receive an impact of the toner particles and the carrier particles when the developer is stirred in the developing apparatus during low coverage printing, and thus, it is possible to make the titanate compound particles unlikely to be buried in the toner base particles.

(Additional External Additive)

From the viewpoint that the external additive according to the present invention control the flowability, chargeability, and the like of the toner particles, another external additive is preferably contained in addition to the titanate compound particles described above. Examples of such an external additive include silica particles, zirconia particles, zinc oxide particles, chromium oxide particles, cerium oxide particles, antimony oxide particles, tungsten oxide particles, tin oxide particles, tellurium oxide particles, manganese oxide particles, and boron oxide particles.

The number average particle size of the additional external additive can be adjusted by classification, mixing of classified materials, or the like. The number average particle size of the additional external additive can be measured in the same manner as the method for measuring the number average particle size of the titanate compound particles described above.

The surface of the additional external additive is preferably hydrophobized, from the viewpoint of improving resistant storability and environmental stability. As the hydrophobization, a known surface modifier is used. Examples of the surface modifier include silane coupling agents, titanate-based coupling agents, aluminate-based coupling agents, fatty acids, fatty acid metal salts, esterified products thereof, rosin acid, and silicone oils.

As the additional external additive, from the viewpoint of imparting of chargeability, silica particles are preferably used, silica particles of which primary particles has a number average particle size within the range of 10 to 60 nm are more preferably used. This allows the flowability of the toner to be improved to enable the toner particles and carrier particles to be sufficiently mixed when the toner is supplied to the developing apparatus. For this reason, stable passage of the amount of charge can be achieved. Additionally, silica particles of which primary particles has a number average particle size within the range of 10 to 60 nm are preferably used in combination with silica particles of which primary particles has a number average particle size within the range of 80 to 150 nm. This makes it possible to lessen the impact of the toner particles and the carrier particles when the developer is stirred in the developing apparatus during low coverage printing.

As the additional external additive, organic particles can be also used. As the organic particles, spherical organic particles having a number average particle size of the order of 10 to 2000 nm can be used. Specifically, organic particles composed of a homopolymer or a copolymer of styrene, methyl methacrylate or the like can be used. As the additional external additive, a lubricant also can be used. The lubricant is used in order to further improve cleaning ability and transferability, and specific examples thereof include metal salts of higher fatty acids, including salts of stearic acid such as zinc stearate, aluminum stearate, copper stearate, magnesium stearate, and calcium stearate, salts of oleic acid such as zinc oleate, manganese oleate, iron oleate, copper oleate, and magnesium oleate, salts of palmitic acid such as zinc palmitate, copper palmitate, magnesium palmitate, and calcium palmitate, salts of linoleic acid such as zinc linoleate and calcium linoleate, and salts of ricinoleic acid such as zinc ricinoleate and calcium ricinoleate.

[Method for Producing Toner]

Examples of a method for producing toner base particles include, but are not limited to, known methods such as a kneading and pulverizing method, a suspension polymerization method, an emulsion aggregation method, a dissolution and suspension method, a polyester extension method, and a dispersion polymerization method. Among these, from the viewpoints of particle size uniformity and shape controllability, the emulsion aggregation method is preferable. The emulsion aggregation method is a method for producing toner base particles by mixing a dispersion of binder resin particles, in which the particles are dispersed by use of a surfactant or a dispersion stabilizer, with a dispersion of colorant particles, as required, allowing the particles to aggregate to a desired toner particle size, and additionally allowing the binder resin particles to be fusion-bonded to one another to thereby control the shape thereof. Here, the binder resin particles may optionally contain a release agent, a charge control agent, and the like.

The external additive can be externally added to the toner base particles using a mechanical mixer. As the mechanical mixer, a Henschel mixer, a Nauta mixer, a Turbula mixer, or the like can be used. It is only required to perform a mixing treatment for a longer mixing time, with an enhanced rotational peripheral speed of the stirring blade, or the like, using a mixer capable of imparting shear force to the particles to be treated, such as a Henschel mixer among these. When a plurality of external additives are used, all the external additives may be mixed at a time to the toner particles, or the external additives in portions may be mixed to the particles depending on the external additives.

[Developer]

The toner can be used as a magnetic or non-magnetic mono-component developer, and may be mixed with a carrier and be used as a bi-component developer.

When the toner is used as a bi-component developer, as the carrier, magnetic particles composed of a conventionally known material, for example, a ferromagnetic metal such as iron, an alloy of a ferromagnetic metal and aluminum, lead and the like, or a ferromagnetic metal compound such as ferrite and magnetite can be used. Particularly, ferrite is preferable.

[Electrophotographic Image Forming System]

The electrophotographic image forming system of the present invention is an electrophotographic image forming system including an electrophotographic image forming apparatus having an electrophotographic photoconductor and a toner, wherein the electrophotographic photoconductor has a protective layer, the surface of the protective layer has a projection structure, the average distance between neighboring projections among a plurality of projections R is within the range of 100 to 250 nm, and the toner contains toner base particles including titanate compound particles attached thereto.

In other words, the electrophotographic image forming system includes an electrophotographic image forming apparatus having the electrophotographic photoconductor and the toner.

Hereinbelow, the electrophotographic image forming apparatus having the electrophotographic photoconductor will be described.

[Electrophotographic Image Forming Apparatus]

The electrophotographic image forming apparatus according to the present invention has the photoconductor mentioned above, a charger that charges the surface of the photoconductor, an light exposer that exposes the charged photoconductor to form an electrostatic latent image, a developing unit that supplies a toner to the photoconductor on which the electrostatic latent image is formed to form a toner image, a transferer that transfers the toner image formed on the photoconductor, and a cleaner that removes the remaining toner remaining on the surface of the photoconductor. As the image forming apparatus according to one aspect of the present invention, preferable is one further having a lubricant supplier that supplies a lubricant to the surface of the photoconductor in addition to these unit.

Hereinbelow, the image forming apparatus according to one aspect of the present invention will be described with reference to the accompanying drawings. However, the present invention is limited to one aspect described below.

Figure 4:
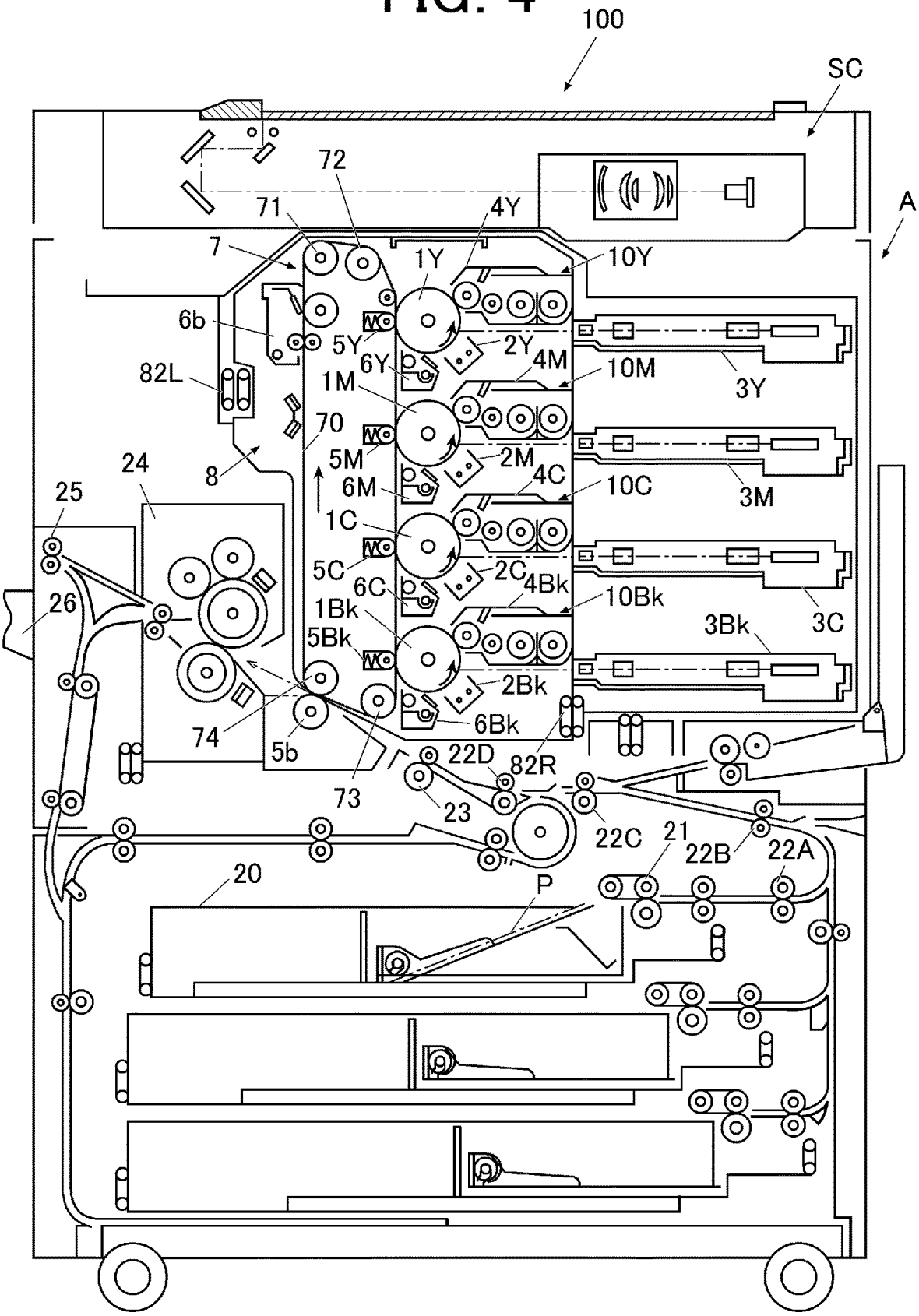
FIG. 4 is a schematic structural view illustrating one exemplary structure of an electrophotographic image forming apparatus according to one aspect of the present invention.
Figure 5:
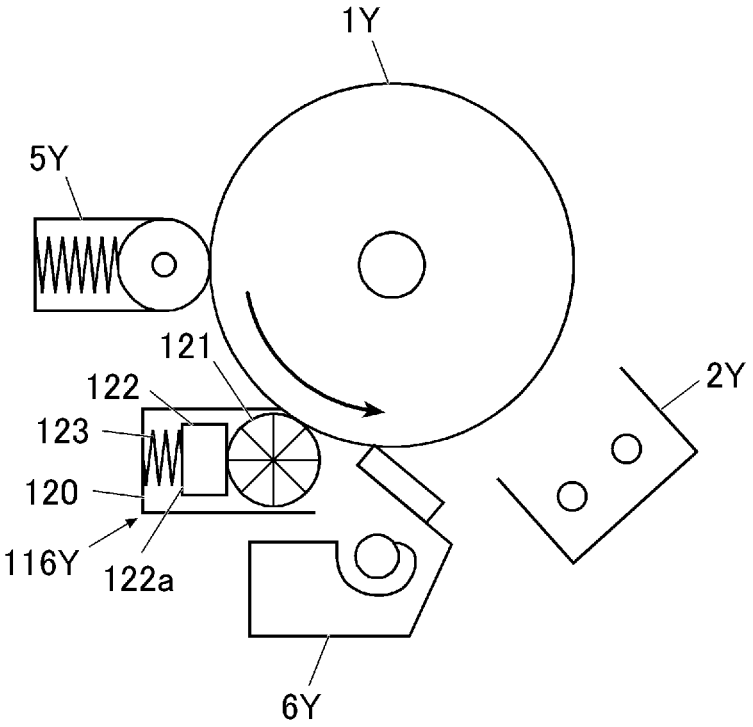
FIG. 5 is a schematic structural view illustrating one example of a non-contact type charger and a lubricant supplier included in the electrophotographic image forming apparatus according to one aspect of the present invention.
Figure 6:
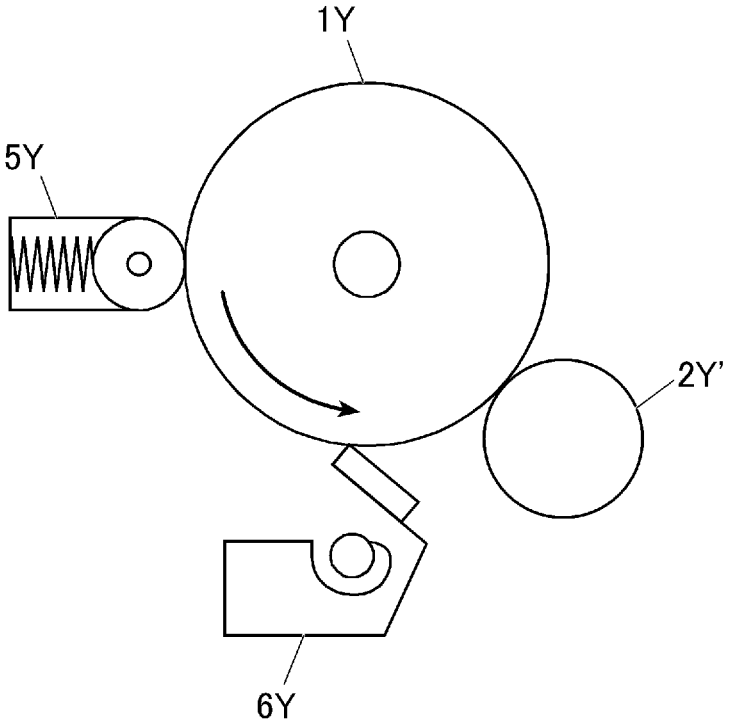
FIG. 6 is a schematic structural view illustrating one example of a proximity charging-type charger included in an image forming apparatus according to another embodiment of the present invention.

FIG. 4 is a schematic structural view illustrating one exemplary structure of an electrophotographic image forming apparatus according to one aspect of the present invention, and FIG. 5 is a schematic structural view illustrating one example of a non-contact type charger and a lubricant supplier included in the electrophotographic image forming apparatus according to one aspect of the present invention. FIG. 6 is a schematic structural view illustrating one example of a proximity charging-type charger included in an image forming apparatus according to another embodiment of the present invention.

An image forming apparatus 100 shown in FIG. 4 is one referred to as a tandem-type color image forming apparatus, which includes four sets of image forming units 10Y, 10M, 10C, and 10Bk, an endless belt-type intermediate transfer member unit 7, a paper feeder 21, a fixer 24, and the like. An original image reader SC is disposed above the apparatus main body A of the image forming apparatus 100.

The image forming unit 10Y that forms yellow color images has a charger 2Y, a light exposer 3Y, a developing unit 4Y, a primary transfer roller (primary transferer) 5Y, and a cleaner 6Y, all of which are sequentially disposed around a drum-type photoconductor 1Y and along in the direction of rotation of the photoconductor 1Y.

The image forming unit 10M that forms magenta color images has a charger 2M, a light exposer 3M, a developing unit 4M, a primary transfer roller (primary transferer) 5M, and a cleaner 6M, all of which are sequentially disposed around a drum-type photoconductor 1M and along in the direction of rotation of the photoconductor 1M.

The image forming unit 10C that forms cyan color images has a charger 2C, a light exposer 3C, a developing unit 4C, a primary transfer roller (primary transferer) 5C, and a cleaner 6C, all of which are sequentially disposed around a drum-type photoconductor 1C and along in the direction of rotation of the photoconductor 1C.

The image forming unit 10Bk that forms black color images has a charger 2Bk, a light exposer 3Bk, a developing unit 4Bk, a primary transfer roller (primary transferer) 5Bk, and a cleaner 6Bk, all of which are sequentially disposed around a drum-type photoconductor 1Bk and along in the direction of rotation of the photoconductor 1Bk.

As the photoconductors 1Y, 1M, 1C, and 1Bk, the photoconductor according to the present invention is used.

The image forming units 10Y, 10M, 10C, and 10Bk are constructed in the same manner except that the colors of toner images formed each on the photoconductor 1Y, 1M, 1C, and 1Bk are different. Thus, the image forming unit 10Y will be described in detail, as an example, and description of the image forming units 10M, 10C, and 10Bk is omitted.

The image forming unit 10Y has the charger 2Y, the light exposer 3Y, the developing unit 4Y, the primary transfer roller (primary transferer) 5Y, and the cleaner 6Y around the photoconductor 1Y as the image forming member to thereby form yellow (Y) toner images on the photoconductor 1Y. In the present aspect, in the image forming unit 10Y, at least the photoconductor 1Y, the charger 2Y, the developing unit 4Y, and the cleaner 6Y are integrally provided.

The charger 2Y is a unit that provides the photoconductor 1Y with a uniform potential, and a contactless charging device, for example, a corona discharge-type charger such as a scorotron, as exemplified in FIGS. 4 and 5, may be used.

Alternatively, as the charger 2Y, a charger 2Y', which is a proximity charging-type charger to charge the photoconductor in a state where a charging roller is in contact with or in proximity to the photoconductor, as exemplified in FIG. 6, may be used instead of a contactless charging device. The charger 2Y' is a unit that charges the photoconductor 1Y surface by means of a charging roller. The charger 2Y' of this example includes a charging roller disposed in contact with the surface of the photoconductor 1Y and a power supply that applies a voltage to the charging roller. The charging roller has, for example, a core metal and an elastic layer laminated on the surface of the core metal, the elastic layer reducing charging noise as well as imparting elasticity to thereby provide uniform adhesion to the photoconductor 1Y. On the surface of the elastic layer, a resistance control layer is laminated, as required, in order for allowing the charging roller as a whole to have highly uniform electric resistance. On the resistance control layer, a surface layer is laminated. The charging roller is configured to be urged by means of a pressing spring in the direction of the photoconductor 1Y and to be brought in pressure contact with the surface of the photoconductor 1Y at predetermined pressing force to thereby form a charging nip section. The charging roller is driven by the rotation of the photoconductor 1Y to thereby rotate.

When the charger 2Y' is used as the charger 2Y, in the technique of JP 2011-13668A mentioned above, the external additive is likely to be liberated from the toner on cleaning. Escape of the liberated external additive and aggregates thereof, and of aggregates of the toner and the liberated external additive on cleaning causes contamination of the charging roller, and furthermore, image defects may occur due to this contamination of the charging roller. However, in the electrophotographic image forming apparatus according to one aspect of the present invention, the plunging force when the remaining toner plunges to the cleaning blade and liberation of the external additive caused by convection of the remaining toner are suppressed as mentioned above. Then, escape of an excessive liberated external additive and aggregates thereof, and of aggregates of the toner and the liberated external additive is reduced. This suppresses contamination of the charging roller caused by the liberated external additive to thereby reduce occurrence of image defects.

The light exposer 3Y is a unit that conducts light exposure, based on an image signal (yellow), and forms an electrostatic latent image corresponding to the yellow color image on the photoconductor 1Y to which a uniform potential has been provided by the charger 2Y. As the light exposer 3Y, for example, one composed of an LED formed by arranging light-emitting elements in the form of an array in the axis direction of photoconductor 1Y, and an imaging element, or a laser optical system is used.

The developing unit 4Y is composed of, for example, a development sleeve having a built-in magnet, holding the developing unit, and rotating, and a voltage application device that applies a direct current and/or alternate current bias voltage between the photoconductor 1Y and this development sleeve.

The primary transfer roller 5Y is a unit that transfers the toner image formed on the photoconductor 1Y on the endless belt-type intermediate transfer member 70 (primary transferer). The primary transfer roller 5Y is disposed in contact with the intermediate transfer member 70.

A lubricant supplier 116Y that supplies (coats) a lubricant on the surface of the photoconductor 1Y is provided at downstream of the primary transfer roller (primary transferer) 5Y and upstream of the cleaner 6Y, as shown in FIG. 5, for example. Alternatively, the lubricant supplier 116Y may be provided at downstream of the cleaner 6Y.

An example of a brush roller 121 constituting the lubricant supplier 116Y is one formed such that a pile woven fabric, which is formed such that bundles of fibers as pile yarn are woven into a base fabric, is formed to be a ribbon fabric, and the ribbon fabric is spirally wound and attached to around a metal shaft with the napped surface outside. The brush roller 121 of this example is, for example, formed such that a long woven fabric, which is formed such that brush fibers made of a resin such as polypropylene are planted at a high density, is formed on the circumferential surface of a roller base.

The brush hair is preferably straight hair napped perpendicular to the metal shaft, from the viewpoint of ability of lubricant coating. The yarn used for the brush hair is preferably filament yarn, and examples of the material thereof include polyamides such as 6-nylon and 12-nylon, polyester, and synthetic resins such as acryl resins and vinylon. In order to enhance the conductivity, a metal such as carbon or nickel may be compounded thereinto. The brush fiber preferably has a thickness of 3 to 7 deniers, a length of 2 to 5 mm, an electric resistivity of $1\times10^{10}\Omega$ or less, a Young's modulus of 4900 to 9800 $N/mm^2$, and a planting density (the number of brush fibers per unit area) of 50000 to 200000 fibers/square inches (50 to 200 k fibers/$inch^2$). The amount of the brush roller 121 intruded into the photoconductor is preferably 0.5 to 1.5 mm. The rotation speed of the brush roller is, for example, 0.3 to 1.5 in a ratio to the peripheral speed of the photoconductor. The rotation direction of the brush roller may be the same as or opposite to the rotation direction of the photoconductor.

As a pressure spring 123, a pressure spring that presses a lubricant 122 in a direction in which the lubricant 122 approaches the photoconductor 1Y such that the pressing force of the brush roller 121 to the photoconductor 1Y is 0.5 to 1.0 N, for example, is used.

In the lubricant supplier 116Y, for example, the pressing force of the lubricant 122 to the brush roller 121 and the rotational speed of the brush roller 121 are adjusted such that an amount of the lubricant consumed per 1 km of the accumulated length on the surface of the rotating photoconductor is preferably 0.05 to 0.27 g/km, more preferably a smaller amount, 0.05 to 0.15 g/km.

The type of the lubricant 122 is not particularly limited, and a known lubricant can be appropriately used. The lubricant preferably contains a fatty acid metal salt.

As the fatty acid metal salt, a saturated or unsaturated fatty acid metal salt having 10 or more carbon atoms are preferable. Examples thereof include zinc laurate, barium stearate, lead stearate, iron stearate, nickel stearate, cobalt stearate, copper stearate, strontium stearate, calcium stearate, cadmium stearate, magnesium stearate, zinc stearate, aluminum stearate, indium stearate, potassium stearate, lithium stearate, sodium stearate, zinc oleate, magnesium oleate, iron oleate, cobalt oleate, copper oleate, lead oleate, manganese oleate, aluminum oleate, zinc palmitate, cobalt palmitate, lead palmitate, magnesium palmitate, aluminum palmitate, calcium palmitate, lead caprate, zinc linolenate, cobalt linolenate, calcium linolenate, zinc ricinoleate, and cadmium ricinoleate. Among these, from the viewpoint of the effect as a lubricant, availability, costs, and the like, zinc stearate is particularly preferable.

As the lubricant supplier, instead of a coater that coats the solid lubricant 122 by use of the brush roller 116Y mentioned above, there may be used a supplier that supplies a lubricant to the surface of the electrophotographic photoconductor by the action of a development electric field formed in the developing unit, via external addition of a micronized lubricant to the toner base particles in production of the toner.

The cleaner 6Y is composed of a cleaning blade and a brush roller provided upstream of this cleaning blade.

The intermediate transfer member unit 7 has the endless belt-type intermediate transfer member 70 wound and rotatably supported by a plurality of rollers 71 to 74. In the endless belt-type intermediate transfer member unit 7, a cleaner 6*b* that removes the toner is disposed on the intermediate transfer member 70.

A casing 8 is composed of the image forming units 10Y, 10M, 10C, and 10Bk and the intermediate transfer member unit 7. The casing 8 is configured so as to be drawable from the apparatus main body A by way of support rails 82L and 82R.

An example of the fixer 24 is a fixer of a heat roller fixing-type one composed of a heating roller including a heating source therein and a pressing roller provided in pressure contact with this heating roller such that a fixing nip is formed.

Note that, in the embodiment described above, the image forming apparatus 100 is a color laser printer, but may be a monochromic laser printer, a copier, a multifunctional machine, or the like. The light source for exposure also may be a light source other than laser, for example, an LED light source.

The electrophotographic image forming apparatus according to one aspect of the present invention may be provided with a lubricant remover that removes the lubricant from the surface of the photoconductor, as required. Specifically, for example, in the image forming apparatus 100, in the direction of rotation of the photoconductor 1Y, the lubricant supplier 116Y is provided downstream of the cleaner 6Y and upstream of the charger 2Y, and additionally, a lubricant remover is disposed downstream of the lubricant supplier 116Y and upstream of the charger 2Y to thereby configure the image forming apparatus.

The lubricant remover is preferably a remover of which removing member comes in contact with the surface of the photoconductor 1Y to remove the lubricant via mechanical action. A removing member such as a brush roller or a foam roller can be used.

The present invention provides a higher effect in case of enhancing the printing speed. Accordingly, the electrophotographic image forming apparatus can preferably achieve a printing speed of 70 sheets/minute (A4 horizontal) or more.

Hereinabove, the embodiment of the present invention has been described, but the present invention is not limited to the embodiment described above, and various modifications can be made.

EXAMPLES

Hereinafter, the present invention will be described specifically by way of Examples, but the present invention is not construed to be limited by these Examples. In the following Examples, operations were performed at room temperature (25° C.), unless otherwise specified. The '%' and "part" mean respectively "% by mass" and "part by mass", unless otherwise specified.

[Production of Metal Oxide Particles (Inorganic Filler)]

A. Production of Radically-Polymerizable Metal Oxide Particles (1) Production of Composite Particulates [1]

Figure 7:
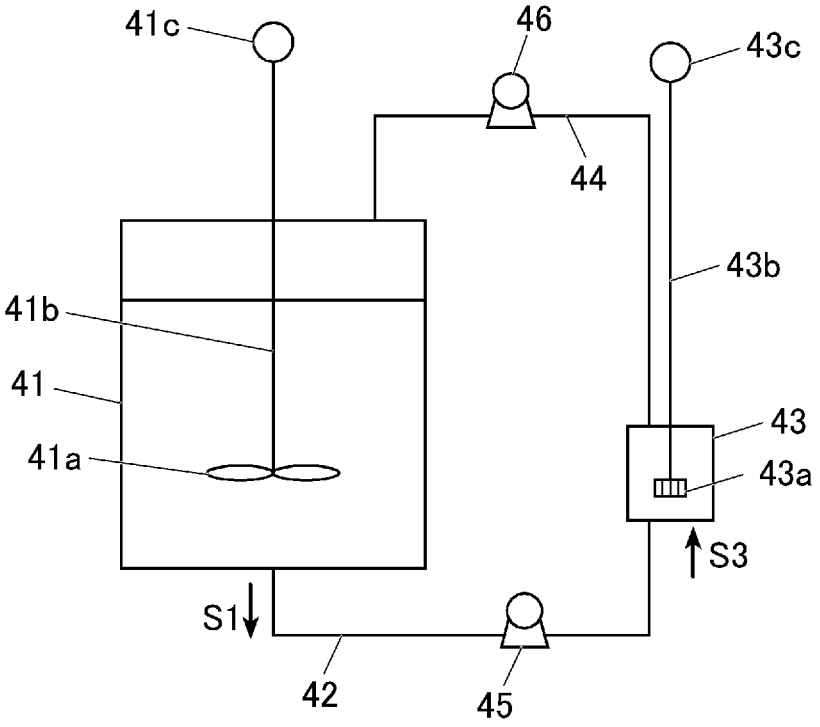
FIG. 7 is a schematic structural view illustrating one example of a production apparatus for use in producing composite particles (core-shell particles).

Composite particulates [1] including a tin oxide coating layer (shell) attached on the surface of a barium sulfate core material (core) were produced using a production apparatus shown in FIG. 7.

Specifically, 3500 $cm^3$ of pure water was introduced in a mother liquor tank 41, 900 g of a spherical barium sulfate core material having an average diameter $D_{50}$ of 100 nm was then introduced therein, and the mixture was circulated for five passes. The flow rate at which the slurry flowed out from the mother liquor tank 41 was 2280 $cm^3$/min. The stirring rate of a strong disperser 43 was set to 16000 rpm. The slurry after completion of the circulation was diluted in a volumetric flask with pure water up to 9000 $cm^3$ in total. Introduced were 1600 g of sodium stannate and 2.3 $cm^3$ of a sodium hydroxide aqueous solution (concentration: 25 N), and the mixture was circulated for five passes. A mother liquor was thus obtained.

While this mother liquor was circulated such that the flow rate 51 flowing out from the mother liquor tank 41 was 200 $cm^3$, 20% sulfuric acid was supplied to a homogenizer "magic LAB" (manufactured by IKA Co., Ltd.) as the strong disperser 43. A supply rate S3 was set to 9.2 $cm^3$/min. The volume of the homogenizer was 20 $cm^3$, and the stirring rate was 16000 rpm. Circulation was performed for 15 minutes, and in the meantime, sulfuric acid was continuously supplied to the homogenizer. There were thus provided particles including tin oxide coating layer formed on the surface of a barium sulfate core.

A slurry containing the resultant particles was subjected to repulp washing until the conductivity thereof was lowered to 600 μS/cm or less, and was then Nutsch-filtered to provide a cake. This cake was dried in the atmosphere at 150° C. for 10 hours. Subsequently, the dried cake was pulverized, and the pulverized powder was reduction-fired under a 1% by volume $H_2/N_2$ atmosphere at 450° C. for 45 minutes. This provided composite particulates including tin oxide attached on the surface of the barium sulfate core material [1].

In the production apparatus shown in FIG. 7, reference numerals 42 and 44 denote circulation piping forming a circulation path between the mother liquor tank 41 and the strong disperser 43, reference numerals 45 and 46 each denote a pump provided on the circulation piping 42 and 44, a reference numeral 41*a* denotes a stirring blade, a reference numeral 43*a* denotes a stirring portion, reference numerals 41*b* and 43*b* each denote a shaft, and reference numerals 41*c* and 43*c* each denote a motor.

(2) Production of Surface-Modified Metal Oxide Particles

<Production of Surface-Modified Metal Oxide Particles [P-1]>

To 100 mL of ethanol, 10 g of silicon dioxide (number average primary particle size=20 nm) was added and dispersed using a US homogenizer for 60 minutes. Then, as a surface modifier, 0.3 g of dimethyidichlorosilane and 10 mL of ethanol were added thereto and dispersed for 30 minutes using a US homogenizer. After the solvent was removed by an evaporator, the residue was heated at 120° C. for an hour to thereby provide surface-modified metal oxide particles having a polymerizable group [P-1].

<Production of Metal Oxide Particles [P-2]>

Tin oxide (number average primary particle size=20 nm) was used as they were, without surface modification, as metal oxide particles [P-2].

<Production of Surface-Modified Metal Oxide Particles [P-3]>

To 100 mL of ethanol, 10 g of tin oxide (number average primary particle size=20 nm) was added and dispersed using a US homogenizer for 60 minutes. Then, as a coupling agent, 0.3 g of 3-methaciyloxypropyltrimethoxysilane (exemplified compound 5-15) ("KBM503" manufactured by Shin-Etsu Silicone) and 10 mL of ethanol were added and dispersed using a US homogenizer for 30 minutes. After the solvent was removed by an evaporator, the residue was heated at 120° C. for an hour to thereby provide metal oxide particles having a polymerizable group.

Five grams of the metal oxide particles obtained above was added to 50 mL of 2-butanol and dispersed using a US homogenizer for 60 minutes. Then, 0.15 g of a surface modifier having a silicone chain as a side chain of the silicone main chain ("KF-9908" manufactured by Shin-Etsu Chemical Co., Ltd.) was added and dispersed using a US homogenizer for 60 minutes. After the solvent was removed by an evaporator, the residue was heated at 120° C. for an hour to thereby provide metal oxide particles surface-modified to have a silicone chain as a side chain and having a polymerizable group [P-3].

<Production of Surface-Modified Metal Oxide Particles [P-4] to [P-6]>

Surface-modified metal oxide particles [P-4] and [P-5] were produced in the same manner except that the number average primary particle size of tin oxide as unmodified metal oxide particles was changed as shown in the following table in the production of surface-modified metal oxide particles [P-3]. Surface-modified metal oxide particles [P-6] were produced in the same manner except that tin oxide was replaced by the composite particulates [1] in the production of surface-modified metal oxide particles [P-3].

<Production of Surface-Modified Metal Oxide Particles [P-7]>

To 100 mL of 2-butanol, 10 g of the composite particles [1] was added and dispersed using a US homogenizer for 60 minutes. Then, 0.3 g of a surface treatment agent having a silicone chain as a side chain of the silicone main chain ("KF-9908" manufactured by Shin-Etsu Chemical Co., Ltd.) and 10 mL of 2-butanol were added and dispersed using a US homogenizer for 60 minutes. After the solvent was removed by an evaporator, the residue was heated at 120° C. for an hour to thereby provide metal oxide particles surface-modified by the surface modifier having a silicone chain as a side chain [P-7].

<Production of Surface-Modified Metal Oxide Particles [P-8] and [P-10] to [P-13]>

Surface-modified metal oxide particles [P-8], [P-10] to [P-13] were produced in the same manner except that the type and number average primary particle size of the unmodified metal oxide particles and the type of the non-reactive surface modifier were changed as shown in the following table in the production of surface-modified metal oxide particles [P-3].

<Production of Surface-Modified Metal Oxide Particles [P-9]>

(Synthesis of fluoroalkyl (meth)acrylate/(meth)acrylic acid copolymer) To a reaction vessel, 9.9 g of 2,2,3,3,4,4,4-heptafluorobutyl methacrylate, 0.1 g of acrylic acid, 0.3 g of a polymerization initiator "PEROYL SA" (manufactured by NOF Corporation), and 60.0 g of a fluorine-based solvent: methyl perfluorobutyl ether (manufactured by Tokyo Chemical Industry Co., Ltd.) were added. The reaction vessel was purged with dry nitrogen and sealed. After heated at 70° C. for 24 hours under stirring, the reaction vessel was cooled and opened.

Then, the solution in the reaction vessel was poured into 300 mL of methanol to precipitate the resultant polymer. The precipitate was dried under vacuum to thereby provide a specific fluorinated surface modifier [A] composed of a 2,2,3,3,4,4,4-heptafluorobutyl methacrylate/acrylic acid copolymer.

(Surface Modification)

To 100 mL of ethanol, 10 g of the composite particles [1] was added and dispersed using a US homogenizer for 60 minutes. Then, as a coupling agent, 0.3 g of 3-methacryloxypropyltrimethoxysilane ("KBM503" manufactured by Shin-Etsu Silicone) and 10 mL, of ethanol were added and dispersed using a US homogenizer for 30 minutes. After the solvent was removed by an evaporator, the residue was heated at 120° C. for an hour to thereby provide metal oxide particles having a polymerizable group.

Five grams of the metal oxide particles obtained above was added to 50 mL of 2-butanol and dispersed using a US homogenizer for 60 minutes. Then, 0.15 g of the fluorinated surface modifier [A] was added thereto and dispersed using a US homogenizer for 60 minutes. After the solvent was removed by an evaporator, the residue was heated at 120° C. for an hour to thereby provide metal oxide particles fluorinated surface-modified and having a polymerizable group [P-9].

<Production of Surface-Modified Metal Oxide Particles [P-14]>

To 100 mL of ethanol, 10 g of the composite particles [1] was added and dispersed using a US homogenizer for 60 minutes. Then, as a coupling agent, 0.3 g of 3-methacryloxypropyltrimethoxysilane (the exemplified compound S-15) ("KBM503" manufactured by Shin-Etsu Silicone) and 10 mL of ethanol were added and dispersed using a US homogenizer for 30 minutes. After the solvent was removed by an evaporator, the residue was heated at 120° C. for an hour to thereby provide metal oxide particles having a polymerizable group [P-14].

The surface modifiers used above are as follows.

KF-9908: branched silicone surface modifier having a silicone chain as a side chain of the silicone main chain (manufactured by Shin-Etsu Chemical Co., Ltd.)

KP-574: branched silicone surface modifier having a silicone chain as a side chain of the acryl main chain (manufactured by Shin-Etsu Chemical Co., Ltd.)

KF-99: linear silicone surface modifier (methyl hydrogen silicone oil) (manufactured by Shin-Etsu Chemical Co., Ltd.)

KF-9901: linear methyl hydrogen silicone oil represented by the following formula (manufactured by Shin-Etsu Chemical Co., Ltd.)

[Formula 4]

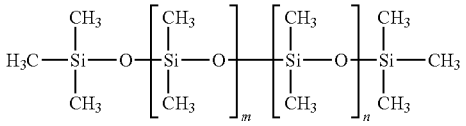

[Production of Photoconductor]

<Production of Photoconductor 1>

A. Preparation of Conductive Support

The surface of a cylindrical aluminum support was cut to prepare a conductive support.

B. Production of Intermediate Layer

The following components were mixed in the following amounts and dispersed in a batch manner using a sand mill as a disperser for 10 hours to prepare a coating solution for intermediate layer. The coating solution was coated to the surface of the conductive support by a dip coating method, and the solution coated was dried at 110° C. for 20 minutes to thereby form an intermediate layer having a film thickness of 2 μm on the conductive support. As a polyamide resin, X1010 (Daicel-Degussa Ltd.) was used. As titanium oxide particles, SMT500SAS (TAYCA CORPORATION) were used.

Polyamide resin: 10 parts by mass

Titanium oxide particles: 11 parts by mass

Ethanol: 200 parts by mass

C. Production of Charge Generation Layer

The following components were mixed in the following amounts and dispersed using a circulating ultrasonic homogenizer (RUS-600TCVP; NIHONSEIKI CO., LTD.) at 19.5 kHz, 600 W, and a circulation flow rate of 40 L/h for 0.5 hours to prepare a coating solution for charge generation layer. The coating solution was coated to the surface of the intermediate layer by a dip coating method, and the solution coated was dried to thereby form a charge generation layer having a film thickness of 0.3 μm on the intermediate layer. As a charge generation material, used were mix crystals of a 1:1 adduct of titanyl phthalocyanine and (2R,3R)-2,3-butanediol having distinct peaks at 8.3°, 24.7°, 25.1°, and 26.5° in Cu-Kα characteristic X-ray diffraction spectrum measurement and unadducted titanyl phthalocyanine. As a polyvinyl butyral resin, S-LEC BL-1 (SEKISUI CHEMICAL CO., LTD., "S-LEC" is a registered trademark of the company.) was used. As a mixed solution, 3-methyl-2-butanone/cyclohexanone=4/1 (V/V) was used.

Charge generation material: 24 parts by mass

Polyvinyl butyral resin: 12 parts by mass

Mixed solution: 400 parts by mass

D. Production of Charge Transport Layer

A coating solution for charge transport layer prepared by mixing the following components in the following amounts was coated to the surface of the charge generation layer by a dip coating method, and the solution coated was dried at 120° C. for 70 minutes to thereby form a charge transport layer having a film thickness of 24 μm on the charge generation layer. As a polycarbonate resin, Z300 (Mitsubishi Gas Chemical Company, Inc.) was used. As an antioxidant, IRGANOX 1010 (BASF SE, "IRGANOX" is a registered trademark of the company.) was used.

Charge transport material having a structure represented by the following structural formula (2): 60 parts by Mass Polycarbonate resin: 100 parts by mass Antioxidant: 4 parts by mass

[Formula 5]

(2)

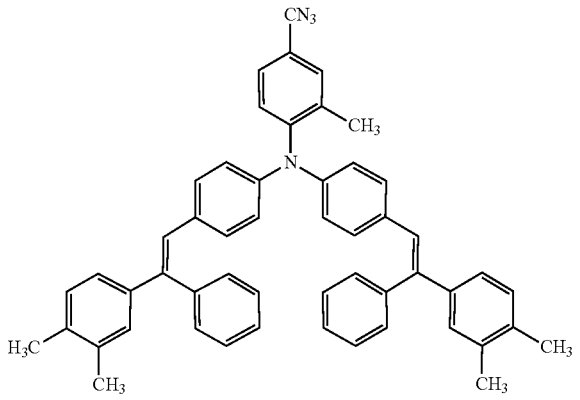

E. Production of Protective Layer

A coating solution for forming protective layer prepared by mixing, dispersing, and dissolving the following components in the following amounts was coated to the surface of the charge transport layer using a round slide hopper coater. Then, the solution coated was dried at 110° C. for 70 minutes to thereby form a thermoplastic protective layer having a dry film thickness of 6.0 μm.

The surface-modified metal oxide particles [P-1] (silica particles (treatment: silica particles surface-treated with dimethylchlorosilane and having a number average primary particle size of 20 nm)): 120 parts by mass Charge transport material: (N-(4-methylphenyl)-N-{4-(β-phenylstyryl)phenyl}-p-toluidine): 150 parts by mass Polycarbonate resin (Z300: manufactured by Mitsubishi Gas Chemical Company, Inc.): 300 parts by mass Antioxidant (IRGANOX 1010: BASF SE, "IRGANOX" is a registered trademark of the company.): 12 parts by mass Tetrahydrofuran (THF): 2800 parts by mass Silicone oil (KF-54: manufactured by Shin-Etsu Chemical Co., Ltd.): 4 parts by mass <Production of Photoconductor 2>

Production was conducted in the same manner as in the production procedure for the photoconductor 1, up to the charge transport layer. A coating solution for protective layer (radically-polymerizable resin composition) prepared by mixing the following components in the following amounts was coated to the surface of the charge transport layer using a round slide hopper coater.

Then, the film of the coated coating solution was irradiated with an ultraviolet ray from a metal halide lamp for a minute to cure the film. This formed a protective layer having a film thickness of 3.0 μm on the charge transport layer. As a polymerization initiator, Irgacure 819 (BASF Japan Ltd.) was used.

Radically-polymerizable monomer (the exemplified compound M2): 120 parts by mass The metal oxide particles [P-2]: 100 parts by mass Polymerization initiator: 10 parts by mass 2-butanol: 400 parts by mass <Production of Photoconductors 3 to 12>

Photoconductors 3 to 12 were produced in the same manner except that the surface-modified metal oxide particles [P-1] were replaced by metal oxide particles shown in the following table in the production of the protective layer of the photoconductor 1.

<Production of Photoconductor 13>

A photoconductor 13 was produced in the same manner except that the metal oxide particles [P-2] were replaced by metal oxide particles shown in the following table and the amount thereof added was changed from 100 parts by mass to 120 parts by mass in the production of the protective layer of the photoconductor 2.

<Production of Photoconductor 14>

A photoconductor 14 was produced in the same manner except that the metal oxide particles [P-2] were replaced by metal oxide particles shown in the following table and the amount thereof added was changed from 100 parts by mass to 75 parts by mass in the production of the protective layer of the photoconductor 2.

[Production of Toner]

<Production of Toner 1>

(1) Production of Toner Base Particles 1

(1.1) Production of Resin Particle a Dispersion for Core Portion (1.1.1) First Stage Polymerization An anionic surfactant solution prepared by dissolving 2.0 parts by mass of sodium lauryl sulfate as an anionic surfactant in 2900 parts by mass of ion exchange water was introduced in advance in a reaction vessel equipped with a stirrer, a temperature sensor, a temperature controller, a condenser, and a nitrogen introducing device. While the solution was stirred under a nitrogen flow at a stirring rate of 230 rpm, the internal temperature was raised to 80° C.

To the anionic surfactant solution, 9.0 parts by mass of potassium persulfate (KPS) as a polymerization initiator was added, and the internal temperature was set to 78° C. To the anionic surfactant solution to which the polymerization initiator was added, a monomer solution 1 prepared by mixing the following components in the following amounts was added dropwise over three hours. After the dropwise addition was completed, polymerization (first stage polymerization) was performed by heating and stirring the solution at 78° C. for an hour to prepare a dispersion of resin particles al.

Styrene: 540 parts by mass n-Butyl acrylate: 154 parts by mass

Methacrylic acid: 77 parts by mass n-Octyl mercaptan: 17 parts by mass (1.1.2) Second Stage Polymerization: Formation of Intermediate Layer A monomer solution 2 was prepared by mixing the following components in the following amounts, adding 51 parts by mass of a paraffin wax (melting point: 73° C.) as an offset preventing agent to the mixture, and heating the mixture to 85° C. to dissolve the wax.

Styrene: 94 parts by mass n-Butyl acrylate: 27 parts by mass

Methacrylic acid: 6 parts by mass n-Octyl mercaptan: 1.7 parts by mass

A surfactant solution prepared by dissolving 2 parts by mass of sodium lauryl sulfate as an anionic surfactant in 1100 parts by mass of ion exchange water was heated to 90° C., and 28 parts by mass of the dispersion of resin particulates al was added in terms of the solid content of the resin particles al to this surfactant solution. Then, the monomer solution 2 was mixed and dispersed using a mechanical disperser having a circulation path ("Clearmix (registered trademark)", manufactured by M Technique Co., Ltd.) for four hours to thereby prepare a dispersion containing emulsified particles having a dispersion particle size of 350 nm An initiator solution prepared by dissolving 2.5 parts by mass of KPS as a polymerization initiator in 110 parts by mass of ion exchange water was added to the dispersion. Polymerization (second stage polymerization) was performed by heating and stirring this system at 90° C. for two hours to thereby prepare a dispersion of resin particles all.

(1.1.3) Third Stage Polymerization: Formation of Outer Layer (Production of Resin Particles for Core Portion A)

An initiator solution prepared by dissolving 2.5 parts by mass of KPS as a polymerization initiator in 110 parts by mass of ion exchange water was added to the dispersion of resin particles all, and a monomer solution 3 prepared by blending the following components in the following amounts was added dropwise thereto over an hour under a temperature condition of 80° C. After the dropwise addition was completed, polymerization (third stage polymerization) was performed by heating and stirring the solution over three hours. Thereafter, the solution was cooled to 28° C. to prepare a dispersion of resin particles for core portion A, in which resin particles for core portion A were dispersed in an anionic surfactant solution. The resin particles for core portion A had a glass transition point of 45° C. and a softening point of 100° C.

Styrene: 230 parts by mass n-Butyl acrylate: 78 parts by mass

Methacrylic acid: 16 parts by mass n-Octyl mercaptan: 4.2 parts by mass (1.2) Preparation of Dispersion of Resin Particles for Shell Layer B (1.2.1) Synthesis of Resin for Shell Layer (Styrene-Acrylic-Modified Polyester Resin B)

To a four-neck flask having a volume of 101 equipped with a nitrogen introducing tube, a dehydration tube, a stirrer, and a thermocouple, the following component 1 was placed in the following amounts, subjected to a polycondensation reaction at 230° C. for eight hours, further allowed to react at 8 kPa for an hour, and cooled to 160° C.

(Component 1)

Bisphenol A propylene oxide dimolar adduct: 500 parts by mass

Terephthalic acid: 117 parts by mass,

Fumaric acid: 82 parts by mass,

Esterification catalyst (tin ocrylate): 2 parts by mass

Subsequently, to the above cooled solution, a mixture prepared by mixing the following component 2 in the following amounts was added dropwise via a dropping funnel over an hour. After the dropwise addition, while the temperature was maintained at 160° C., an addition polymerization reaction was continued for an hour. Then, the temperature was raised to 200° C., and the solution was maintained at 10 kPa for an hour. Thereafter, unreacted acrylic acid, styrene, and butyl acrylate were removed to thereby provide a styrene-acrylic-modified polyester resin B. The resultant styrene-acrylic-modified polyester resin B had a glass transition point of 60° C. and a softening point of 105° C.

(Component 2)

Acrylic acid: 10 parts by mass

Styrene: 30 parts by mass

Butyl acrylate: 7 parts by mass

Polymerization initiator (di-t-butyl peroxide): 10 parts by mass (1.2.2) Production of Dispersion of Resin Particles for Shell Layer B Pulverized was 100 parts by mass of the resultant styrene-acrylic-modified polyester resin B in a pulverizer (Roundel Mill, model RM; TOKUJU Co., LTD). The pulverized resin was mixed with 638 parts by mass of a sodium lauryl sulfate solution having a concentration of 0.26% by mass prepared in advance. Under stirring, the mixture was ultrasonically dispersed using an ultrasonic homogenizer ("US-150T" manufactured by NIHONSEIKI CO., LTD.) at V-LEVEL and 300 μA for 30 minutes to thereby prepare a dispersion of resin particles for shell layer B, in which resin particles for shell layer B having a median diameter based on a number basis (D50) of 250 nm were dispersed.

(1.3) Production of Dispersion of Colorant Particles 1

Stirred and dissolved was 90 parts by mass of sodium dodecyl sulfate in 1600 parts by mass of ion exchange water. While this solution was stirred, 420 parts by mass of carbon black ("MOGUL L", manufactured by Cabot Corporation) was gradually added to the solution. Then, the solution was subjected to a dispersion treatment using a stirrer ("Clearmix (registered trademark)", manufactured by M Technique Co., Ltd.) to thereby prepare a dispersion of colorant particles 1, in which colorant particles were dispersed.

The particle size of the colorant particles in this dispersion was measured by a Microtrac particulate size distribution measurement apparatus ("UPA-150", manufactured by Nikkiso Co., Ltd.) to be 117 nm.

(1.4) Production of Toner Base Particles 1 (Aggregation, Fusion Bonding-Washing-Drying)

To a reaction vessel equipped with a stirrer, a temperature sensor, and a condenser, 288 parts by mass of the dispersion of particles for core portion resin A in terms of the solid content and 2000 parts by mass of ion exchange water were introduced, a 5 mol/L sodium hydroxide aqueous solution was added thereto, and the pH was adjusted to 10 (25° C.).

Thereafter, 40 parts by mass of the dispersion of colorant particles 1 was introduced in terms of the solid content. Then, an aqueous solution prepared by dissolving 60 parts by mass of magnesium chloride in 60 parts by mass of ion exchange water was added thereto under stirring at 30° C. over 10 minutes.

Thereafter, the mixture was left for three minutes, and then, temperature raising was started. The temperature of this system was raised to 80° C. over 60 minutes, and a particle growth reaction was continued while the temperature of 80° C. was maintained. In this state, the particle size of the core particles was measured in a precise particle size distribution measurement apparatus ("Multisizer3", manufactured by Beckman Coulter Inc.). When the median diameter based on a number basis ($D_{50}$) reached 5.8 μm, 72 parts by mass of the dispersion of resin particles for shell layer B in terms of the solid content was introduced over 30 minutes. When the supernatant of the reaction liquid became clear, an aqueous solution prepared by 190 parts by mass of sodium chloride in 760 parts by mass of ion exchange water was added thereto to stop the particle growth. Furthermore, the temperature was raised, and the solution was heated and stirred at 90° C. to allow fusion bonding of the particles to proceed. When the average circularity was reached 0.945, which was measured using a measurement apparatus for toner average circularity ("FPIA-2100", manufactured by Sysmex Corporation) (HPF detection number: 4000), the solution was cooled to 30° C. to thereby provide a dispersion of toner base particles 1.

This dispersion of toner base particles 1 was subjected to solid-liquid separation in a centrifuge to form a wet cake of the toner base particles 1. This wet cake was washed with ion exchange water at 35° C. until the electrical conductivity of the filtrate reached 5 μS/cm. Thereafter, the wet cake was transferred to an airflow-type" dryer ("FLASH JET DRYER", manufactured by SEISHIN ENTERPRISE CO., LTD.) and dried until the water content of 0.5% by mass to thereby provide toner base particles 1.

When the particle size of the toner base particles 1 was measured in a precise particle size distribution measurement apparatus ("Multisizer3", manufactured by Beckman Coulter Inc.), the median diameter based on a number basis ($D_{50}$) was 6.0 μm.

(2) Production of Toner 1

To 100 parts by mass of the toner base particles 1 prepared above, 0.3 parts by mass of silica particles 1 (number average primary particle size=110 nm, HMDS treatment), 0.8 parts by mass of silica particles 2 (number average primary particle size=12 nm, HMDS treatment), and 0.5 parts by mass of calcium titanate particles (number average primary particle size=100 nm, silicone oil treatment) were added as external additives. This mixture was added to a Henschel mixer model "FM20C/I" (manufactured by Nippon Coke & Engineering Co., Ltd.). The rotational speed was adjusted such that the peripheral speed of the blade tip was 40 m/s, and the mixture was stirred for 20 minutes to thereby prepare a toner 1.

<Production of Toners 2 and 3>

Toners 2 and 3 were produced in the same manner except that strontium titanate and barium titanate listed in the following table were each used instead of the calcium titanate particles (number average primary particle size=100 nm) in the production of toner 1.

<Production of Toners 4 and 5>

Toners 4 and 5 were produced in the same manner except that the number average primary particle size of calcium titanate particles changed as listed in the following table in the production of toner 1.

<Production of Toner 6>

A toner 6 was produced in the same manner except that the calcium titanate particles (number average primary particle size=100 nm) were replaced by titanium dioxide listed in the following table in the production of toner 1.

[Evaluations]

A full color printer ("bizhub PRESS (registered trademark) C1070", manufactured by Konica Minolta, Inc.) was used.

In a normal-temperature and normal-humidity environment (temperature 20° C., humidity 50% RH), a band-like solid image having 5% printed characters as a test image was formed by printing on 1000 sheets of A4-sized woodfree paper (65 g/m$^2$).

Then, in a high-temperature and high-humidity environment (temperature 30° C., humidity 80% RH), a band-like solid image having a coverage rate of 5% as a test image was formed by printing on 70000 sheets of A4-sized woodfree paper (65 g/m$^2$), and then, a band-like solid image having a coverage rate of 40% was formed by printing on 30000 sheets.

Subsequently, in a low-temperature and low-humidity environment (temperature 10° C., humidity 20% RH), printing was performed on 100000 sheets in total in the same manner. At the timing after printing on 1000 sheets (initial (NN)), the timing after printing on 100000 sheets (100 kp (HH)), and the timing after printing on 200000 sheets (200 kp (LL)), the following evaluations were performed.

(1) Wear of Photoconductor

The amounts of depletion in the film thickness of the protective layer of the photoconductor before and after the above resistance test were used for the evaluation. Specifically, as the film thickness of the protective layer, the film thickness at 10 points at random on the uniform film thickness portion (a film thickness profile is produced excluding portions in which the film thickness varies, that is, the front end and rear end of coating) was measured, and the average value thereof was taken as the film thickness of the protective layer.

The film thickness meter used was an eddy current-type film thickness meter "EDDY560C" (manufactured by Helmut Fischer GmbH & Co), and the difference of the film thickness of the protective layer between before and after the resistance test was calculated as the amount of depletion in the film thickness (μm). The amounts of depletion of 0.20 μm or less were determined to be practicable.

(Evaluation criteria)

A: The amount of depletion is 0.05 μm or less.

B: The amount of depletion is more than 0.05 μm and 0.10 μm or less.

C: The amount of depletion is more than 0.10 μm and 0.15 μm or less.

D: The amount of depletion is more than 0.15 μm and 0.20 μm or less.

E: The amount of depletion is more than 0.20 μm.

(2) Wear of Cleaning Blade

After the resistance experiment, the cleaning blade was observed using a shape measurement laser microscope "VK-X100" (manufactured by KEYENCE CORPORATION), and the wear width was calculated. Then, the difference in the wear width in the cleaning blade between before and after the above resistance experiment was taken as the amount of wear, which was evaluated in accordance with the following evaluation criteria. Toners resulting in an amount of wear of 40 μm or less were determined to be practicable.

(Evaluation Criteria)

A: The amount of depletion is 10 μm or less.

B: The amount of depletion is more than 10 μm and 20 μm or less.

C: The amount of depletion is more than 20 μm and 30 μm or less.

D: The amount of depletion is more than 30 μm and 40 μm or less.

E: The amount of depletion is more than 40 μm.

(3) FD Lines (Cleaning Ability)

After the above resistance test, in an environment of 10° C. and 15% RH, a half tone image was printed on 100 sheets of A3-sized neutral paper such that the printed area was positioned in the front portion of, and the blank area was positioned in the rear portion of the conveying direction of paper. The blank area of the 100th print was visually observed for smears caused due to escape of the toner, and the cleaning ability was evaluated in accordance of the following evaluation criteria.

(Evaluation Criteria)

A: No escape is observed at all, and there is no problem.

B: Escape is partially observed, but FD lines are not observed on the image, and thus there is no practical problem.

C: Escape is observed, FD lines are also observed on the image, and thus there is a practical problem.

(4) Amount of Charge

A 400-mesh stainless steel screen was attached to a blow-off charge measuring apparatus "blow-off type TB-200" (manufactured by Toshiba Corporation), and the toner in the developing device, after the above printing was carried out, was blown with nitrogen gas for 10 seconds under a blow pressure condition of 0.5 kgf/cm$^2$ (0.049 MPa). The amount of charge (μC/g) was calculated by dividing the electric charge measured after the blowing by the mass of toner caused to fly by the blowing.

TABLE 1

| | Photoconductor | | | | | | | | |
|---|---|---|---|---|---|---|---|---|---|
| | | Metal oxide particles (inorganic filler) | | | | | | Toner | |
| | | | Unmodified metal oxide particles | | | | | | |
| | | | | Number average primary particle size | Surface modifier | | Average distance between projections | | External additive |
| | No. | No. | Type | [nm] | Non-reactive | Reactive | R [nm] | No. | Type |
| Example 1 | 1 | P-1 | $SiO_2$ | 20 | Dimethyl-dichlorosilane | — | 140 | 1 | Calcium titanate |
| Example 2 | 2 | P-2 | $SnO_2$ | 20 | — | — | 130 | 1 | Calcium titanate |
| Example 3 | 3 | P-3 | $SnO_2$ | 20 | KF9908 (Side chain) | S-15 | 120 | 1 | Calcium titanate |
| Example 4 | 4 | P-4 | $SnO_2$ | 100 | KF9908 (Side chain) | S-15 | 180 | 1 | Calcium titanate |
| Example 5 | 5 | P-5 | $SnO_2$ | 250 | KF9908 (Side chain) | S-15 | 240 | 1 | Calcium titanate |
| Example 6 | 6 | P-6 | $SnO_2$/$BaSO_4$ | 100 | KF9908 (Side chain) | S-15 | 160 | 1 | Calcium titanate |
| Example 7 | 6 | P-6 | $SnO_2$/$BaSO_4$ | 100 | KF9908 (Side chain) | S-15 | 160 | 2 | Strontium titanate |
| Example 8 | 6 | P-6 | $SnO_2$/$BaSO_4$ | 100 | KF9908 (Side chain) | S-15 | 160 | 3 | Barium titanate |
| Example 9 | 6 | P-6 | $SnO_2$/$BaSO_4$ | 100 | KF9908 (Side chain) | S-15 | 160 | 4 | Calcium titanate |
| Example 10 | 6 | P-6 | $SnO_2$/$BaSO_4$ | 100 | KF9908 (Side chain) | S-15 | 160 | 5 | Calcium titanate |
| Example 11 | 7 | P-7 | $SnO_2$/$BaSO_4$ | 100 | KF9908 (Side chain) | — | 170 | 1 | Calcium titanate |
| Example 12 | 8 | P-8 | $SnO_2$/$BaSO_4$ | 100 | KP574 (Side chain) | S-15 | 170 | 1 | Calcium titanate |
| Example 13 | 9 | P-9 | $SnO_2$/$BaSO_4$ | 100 | Fluorinated surface modifier [A] | S-15 | 180 | 1 | Calcium titanate |
| Example 14 | 10 | P-10 | $SnO_2$/$BaSO_4$ | 100 | KF9901 (Linear) | S-15 | 180 | 1 | Calcium titanate |
| Example 15 | 11 | P-11 | $SnO_2$/$BaSO_4$ | 100 | KF99 (Linear) | S-15 | 220 | 1 | Calcium titanate |
| Example 16 | 12 | P-12 | $SnO_2$/$BaSO_4$ | 200 | KF9908 (Side chain) | S-15 | 230 | 1 | Calcium titanate |
| Comparative Example 1 | 13 | P-13 | $SnO_2$ | 20 | KF9908 (Side chain) | S-15 | 80 | 1 | Calcium titanate |
| Comparative Example 2 | 14 | P-14 | $SnO_2$/$BaSO_4$ | 100 | — | S-15 | 280 | 1 | Calcium titanate |
| Comparative Example 3 | 6 | P-6 | $SnO_2$/$BaSO_4$ | 100 | KF9908 (Side chain) | S-15 | 160 | 6 | Titanium dioxide |

TABLE 1-continued

| | Toner External additive Number average primary particle size [nm] | Wear of photo-conductor | Wear of blade | FD lines | Amount of charge Initial (NN) [μC/g] | 100 kp (HH) [μC/g] | 200 kp (LL) [μC/g] |
|---|---|---|---|---|---|---|---|
| Example 1 | 100 | D | C | B | 51.2 | 41.8 | 52.7 |
| Example 2 | 100 | C | C | B | 51.1 | 42.2 | 53.1 |
| Example 3 | 100 | B | C | B | 50.3 | 44.3 | 53.2 |
| Example 4 | 100 | B | B | A | 51.0 | 43.7 | 53.0 |
| Example 5 | 100 | C | B | B | 51.2 | 42.9 | 52.8 |
| Example 6 | 100 | A | A | A | 49.8 | 43.5 | 52.5 |
| Example 7 | 100 | A | A | A | 49.7 | 43.6 | 52.6 |
| Example 8 | 100 | A | A | B | 51.2 | 41.7 | 52.1 |
| Example 9 | 40 | B | B | B | 53.5 | 46.2 | 57.7 |
| Example 10 | 200 | B | B | B | 44.2 | 37.3 | 48.2 |
| Example 11 | 100 | B | A | A | 50.3 | 42.2 | 51.6 |
| Example 12 | 100 | A | A | A | 50.1 | 43.1 | 52.8 |
| Example 13 | 100 | B | B | B | 50.2 | 44.3 | 53.1 |
| Example 14 | 100 | B | B | B | 50.7 | 42.9 | 52.9 |
| Example 15 | 100 | B | B | B | 49.5 | 42.8 | 51.5 |
| Example 16 | 100 | A | A | A | 49.6 | 43.8 | 52.0 |
| Comparative Example 1 | 100 | E | C | C | 48.6 | 39.6 | 52.3 |
| Comparative Example 2 | 100 | E | D | C | 50.3 | 41.0 | 54.0 |
| Comparative Example 3 | 100 | C | C | C | 41.8 | 25.2 | 42.6 |

As indicated by the above results, it can be seen that variation in the amount of charge is suppressed, wear of the photoconductor and the cleaning blade is reduced, and the cleaning ability is satisfactory in cases where a combination of a photoconductor and a toner as in Examples 1 to 16 is employed, in comparison with cases where a combination of a photoconductor and a toner as in Comparative Examples 1 to 3 is employed.

Although embodiments of the present invention have been described and illustrated in detail, the disclosed embodiments are made for purposes of illustration and example only and not limitation. The scope of the present invention should be interpreted by terms of the appended claims The entire disclosure of Japanese Patent Application No. 2019-071087, filed on Apr. 3, 2019, is incorporated herein by reference in its entirety.

What is claimed is:

1. An electrophotographic image forming method using an electrophotographic photoconductor, wherein the electrophotographic photoconductor has a protective layer, the surface of the protective layer has a projection structure, the average distance between neighboring projections among a plurality of projections R is set within a range of 100 to 250 nm, a toner including titanate compound particles attached to toner base particles is used, and the titanate compound particles are selected from the group consisting of calcium titanate particles, strontium titanate particles, and barium titanate particles.

2. The electrophotographic image forming method according to claim 1, wherein the protective layer contains a polymerization-cured product of a composition containing a polymerizable monomer and an inorganic filler.

3. The electrophotographic image forming method according to claim 1, wherein the protective layer contains an inorganic filler surface-modified with a surface modifier.

4. The electrophotographic image forming method according to claim 3, wherein the surface modifier has a silicone chain.

5. The electrophotographic image forming method according to claim 4, wherein the surface modifier has a silicone chain as a side chain.

6. The electrophotographic image forming method according to claim 2, wherein a number average primary particle size of the inorganic filler is within a range of 50 to 200 nm.

7. The electrophotographic image forming method according to claim 1, wherein the titanate compound particles are the calcium titanate particles or the strontium titanate particles.

8. The electrophotographic image forming method according to claim 1, wherein a number average primary particle size of the titanate compound particles is within a range of 50 to 150 nm.

9. The electrophotographic image forming method according to claim 6, wherein the inorganic filler has a polymerizable group.

10. The electrophotographic image forming method according to claim 6, wherein the inorganic filler is composite particulates including a metal oxide attached on the surface of a core material.

11. An electrophotographic image forming system comprising an electrophotographic image forming apparatus having an electrophotographic photoconductor and a toner, wherein the electrophotographic photoconductor has a protective layer, the surface of the protective layer has a projection structure, the average distance between neighboring projections among a plurality of projections R is within a range of 100 to 250 nm, the toner contains toner base particles comprising titanate compound particles attached thereto, and the titanate compound particles are selected from the group consisting of calcium titanate particles, strontium titanate particles, and barium titanate particles.

12. The electrophotographic image forming method according to claim 1, wherein the protective layer comprises an inorganic filler, and the projection structure is constituted by the inorganic filler exposed on the surface of the protective layer.

* * * * *